US011053465B2

(12) United States Patent
Zerhusen et al.

(10) Patent No.: US 11,053,465 B2
(45) Date of Patent: Jul. 6, 2021

(54) METHODS OF TREATING FABRICS AND RELATED COMPOSITIONS

(71) Applicant: The Procter & Gamble Company, Cincinnati, OH (US)

(72) Inventors: Jaden Scott Zerhusen, Florence, KY (US); Julie Ann O'Neil, Dillsboro, IN (US); Rajan Keshav Panandiker, West Chester, OH (US); Alessandro Corona, III, Wyoming, OH (US); Carola Barrera, West Chester, OH (US); Andrew William Franckhauser, Batavia, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 7 days.

(21) Appl. No.: 16/430,458

(22) Filed: Jun. 4, 2019

(65) Prior Publication Data

US 2019/0367849 A1 Dec. 5, 2019

Related U.S. Application Data

(60) Provisional application No. 62/680,053, filed on Jun. 4, 2018.

(51) Int. Cl.
*C11D 17/00* (2006.01)
*C11D 3/00* (2006.01)
(Continued)

(52) U.S. Cl.
CPC ..... *C11D 17/0043* (2013.01); *C11D 3/001* (2013.01); *C11D 3/245* (2013.01);
(Continued)

(58) Field of Classification Search
CPC ..... C11D 11/0017; C11D 3/505; C11D 3/373; C11D 3/0094; C11D 17/0013; C11D 17/0043
See application file for complete search history.

(56) References Cited

U.S. PATENT DOCUMENTS 4,242,377 A 12/1980 Furgal
4,562,097 A 12/1985 Walter
(Continued)

FOREIGN PATENT DOCUMENTS

EP 753559 A1 * 1/1997
GB 1377425 12/1974
(Continued)

OTHER PUBLICATIONS

International Search Report; International Application No. PCT/US2019/035280; dated Sep. 16, 2019; 15 pages.

*Primary Examiner* — John R Hardee
(74) *Attorney, Agent, or Firm* — Gregory S. Darley-Emerson

(57) ABSTRACT

A process of treating a fabric with a fabric treatment composition, where the composition is provided to a receiving vessel such as the dispenser drawer of an automatic washing machine, the composition including a fabric conditioning active (FCA), where the composition may be dispensed from a container, for example a pressurized container, as a foam. Related compositions, including compositions in pressurized containers. Related uses, for example, to provide an anti-wrinkle benefit to a fabric.

9 Claims, 5 Drawing Sheets

(51) Int. Cl.

| | |
|---|---|
| ***C11D 3/24*** | (2006.01) |
| ***C11D 3/30*** | (2006.01) |
| ***C11D 3/37*** | (2006.01) |
| ***C11D 3/50*** | (2006.01) |
| ***C11D 11/00*** | (2006.01) |

(52) U.S. Cl.
CPC ..... *C11D 3/30* (2013.01); *C11D 3/373* (2013.01); *C11D 3/505* (2013.01); *C11D 11/0017* (2013.01)

(56) References Cited

U.S. PATENT DOCUMENTS

| | | | |
|---|---|---|---|
| 4,834,968 | A | 5/1989 | Bolich, Jr. |
| 5,968,202 | A | 10/1999 | Verbiest |
| 5,981,459 | A | 11/1999 | Verbiest |
| 9,719,052 | B2 | 8/2017 | Hulskotter |
| 2002/0077265 | A1 | 6/2002 | Buzzacarini |
| 2003/0053961 | A1 | 3/2003 | Eccard |
| 2003/0216488 | A1 | 11/2003 | Uchiyama |
| 2005/0098759 | A1 | 5/2005 | Frankenbach |

FOREIGN PATENT DOCUMENTS

| | | | |
|---|---|---|---|
| GB | 1384895 | | 2/1975 |
| WO | WO2016096347 | A1 | 6/2016 |

* cited by examiner

METHODS OF TREATING FABRICS AND RELATED COMPOSITIONS

FIELD OF THE INVENTION

The present disclosure relates to the process of treating a fabric with a fabric treatment composition. The composition may be provided to a receiving vessel such as the dispenser drawer of an automatic washing machine. The composition may include a fabric conditioning active (FCA), and the composition may be dispensed from a container, for example, a pressurized container, or otherwise provided as a foam. The present disclosure also relates to related compositions, including compositions in pressurized containers, and related uses.

BACKGROUND OF THE INVENTION

Many modern automatic washing machines include one or more compartments or drawers designed to receive treatment compositions. Whereas previous generations of consumers had to pour treatment compositions directly into the main drum of the washing machine, today's consumers can pour the compositions into certain receiving vessels, such as a dispenser drawer, where the composition can automatically be dispensed at the proper time according to a treatment cycle selected. Such vessels are particularly useful for compositions intended to be added during a rinse cycle, which typically follows a wash cycle, so that the consumer can add all of the necessary compositions (detergent, fabric enhancer, etc.) at the same time without having to wait near the machine for the rinse cycle to begin.

Typically, such receiving vessels, such as dispenser drawers, call for the use of liquid treatment compositions, so that composition may flow from the drawer into the drum at the proper time. However, liquids can be inconvenient and/or messy to dispense. For example, such liquids may spill or drip onto the machine, the user's hands, or the composition's container. Furthermore, typically usage of such liquids calls for two pours—one from the liquid's container into a dosing cap, and one from the dosing cap into the drawer—which increases the likelihood for spills to occur.

Unitized dose articles, which may be in the form of pouch, e.g., a composition encapsulated in water-soluble film, are generally convenient and less messy to use, but these are typically not suitable for usage with a dispenser drawer, owing to dissolution and/or release challenges.

Additionally, such dispenser drawers comprise limited volumes, so any composition that is used in combination with such drawers must be capable of providing sufficient levels of active ingredients in view of the limited space available in order to provide the desired treatment benefits. That being said, compositions having increased activity levels of fabric conditioning actives tend to be physically unstable and may phase separate. Such compositions may also be challenging to efficiently dispense into the drum of a washing machine.

Further, it is known to apply certain treatment or conditioning foams directly to fabrics. However, the benefit agents of these foams may be washed away during a wash cycle, particularly in the presence of surfactant-comprising detergents, instead of depositing onto the target fabrics. Additionally, direct application of such foams, which may include silicones, may lead to poor distribution in the wash water and/or undesirable spotting on fabrics, as the hydrophobic active material may stick to the fabric onto which it is directly applied.

Finally, doing laundry is often a daily or weekly household chore, so it is desirable to make the laundry experience more enjoyable.

There is a need for fabric treatment compositions that are convenient and/or enjoyable to use, particularly in combination with a receiving vessel such as the dispenser drawer of an automatic washing machine, while still providing desired treatment benefits.

SUMMARY OF THE INVENTION

The present disclosure relates to processes of treating a fabric with fabric treatment compositions that includes a fabric conditioning active (FCA).

For example, the present disclosure relates to a process of treating a fabric with a fabric treatment composition, the process including the steps of: (a) providing a fabric treatment product, the product including a fabric treatment composition contained in a container, the fabric treatment composition comprising a fabric conditioning active (FCA); (b) dispensing the fabric treatment composition from the container as a foam, wherein the foam is provided to a receiving vessel, wherein the vessel comprises a receiving volume of from about 10 mL to about 500 mL, preferably from about 25 mL to about 350 mL, more preferably from about 50 mL to about 150 mL; (c) providing the fabric treatment composition to a drum of an automatic washing machine; (d) combining the fabric treatment composition with water to form a treatment liquor; and (e) contacting a fabric in the drum of the automatic washing machine with the treatment liquor.

The present disclosure also relates to fabric treatment compositions that include a fabric conditioning active (FCA). For example, the present disclosure relates to a fabric treatment composition, the composition including a fabric conditioning active (FCA), the composition being contained in a container, wherein, immediately after being dispensed from the container, the composition is in the form of a foam having a density of from about 0.05 to about 0.5 g/mL, or from about 0.1 to about 0.4 g/mL, or from about 0.1 to about 0.3 g/mL, or from about 0.2 to about 0.3 g/mL.

The present disclosure also relates to a fabric treatment composition, the fabric treatment composition including a fabric conditioning active (FCA), the composition further including encapsulated perfume, wherein the fabric treatment composition is contained in a pressurized container.

The present disclosure also relates to a fabric treatment composition, the fabric treatment composition including a fabric conditioning active (FCA), the composition further including hydrofluoroolefin propellant, wherein the fabric treatment composition is contained in a pressurized container.

The present disclosure also relates to a fabric treatment composition, the fabric treatment composition including a fabric conditioning active (FCA), the fabric treatment composition is contained in a pressurized container, wherein the fabric treatment composition is characterized by a first density of from about 0.05 to about 0.5 g/mL, or from about 0.1 to about 0.4 g/mL, or from about 0.1 to about 0.3 g/mL, or from about 0.2 to about 0.3 g/mL, as determined immediately after dispensing from the container, and a second density of from about 0.6 g/mL to about 1.1 g/mL, as determined ten minutes after being dispensed.

The present disclosure further relates to the use of a fabric treatment composition, where the composition provides an anti-wrinkle and/or a wrinkle reduction benefit to a fabric, when the fabric is treated with a treatment liquor comprising water and the fabric treatment composition, preferably when the composition is dispensed from a container as a foam.

BRIEF DESCRIPTION OF THE DRAWINGS

The figures herein are illustrative in nature and are not intended to be limiting.

DETAILED DESCRIPTION OF THE INVENTION

Figure 1:
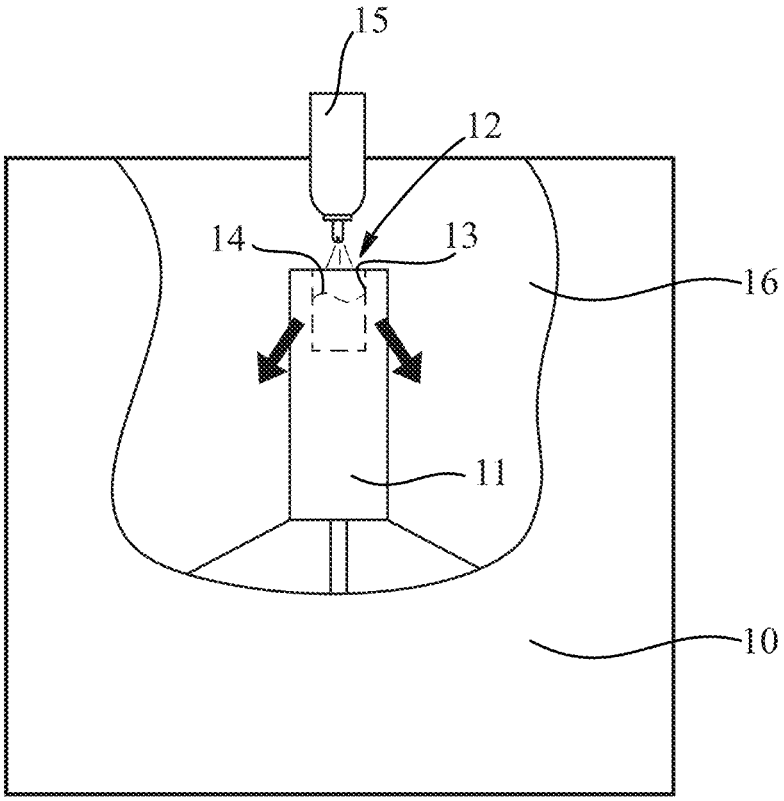
FIG. 1 shows a schematic drawing of a top-loading automatic washing machine.

The present disclosure relates to methods of treating fabric with fabric treatment compositions in an automatic washing machine, as well as related treatment compositions and products. The methods relate to first providing the fabric treatment composition to a smaller receiving vessel, such as the dispensing drawer of an automatic washing machine, and then providing it to the larger drum of the machine where the fabrics are treated.

Whereas typical treatment methods comprise pouring liquids into the dispensing drawer or other suitable receiving vessel, the present disclosure relates to spraying the treatment composition and/or providing it as a foam. It is believed that providing the treatment composition in such a form can help to reduce messy spills. For example, the container, which may be a trigger sprayer or a pressurized container, such as an aerosol can, can be closely and directly pointed at the receiving volume of the receiving vessel. Foams tend to be more viscous than liquid compositions and are less likely to splash or drip. Further, such sprayable/foamable compositions are more convenient than traditional liquid products, in that the containers may be operated single-handedly, and with only one dispensing step (from container to vessel, instead of from container to dosing cup to machine). Additionally or alternatively, providing such compositions in a pressurized/aerosol bottle can mitigate the phase separation challenges associated with liquids compositions having relatively high levels of hydrophobic actives.

The methods, products, and compositions of the present disclosure may be selected so that a suitable amount of composition and/or active ingredient is provided to the limited volume of the receiving vessel (e.g., dispensing drawer) in order to give desired treatment benefits. The methods, products, and compositions of the present disclosure may also be selected so as to provide such amounts in a suitable period of time, e.g., a time period and/or a flow rate that is convenient for consumer use.

The methods, compositions, and products are discussed in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric treatment composition" includes compositions and formulations designed for treating fabrics.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Process for Treating a Fabric

The present disclosure relates to a process for treating a fabric with a fabric treatment composition. The process may include providing a fabric treatment product. The fabric treatment product may include a fabric treatment composition in a container, which may include dispensing means such as a valve. The fabric treatment composition may include a fabric conditioning active (FCA). Such products, composition, containers, and agents are discussed in more detail below.

The process may include providing the fabric treatment composition to a receiving vessel; the fabric treatment composition may be provided to the receiving vessel as a foam. The process may include dispensing the fabric treatment composition from the container to a receiving vessel. The fabric treatment composition may be dispensed from the container as a foam. The process may include shaking or otherwise agitating the container, which may help with mixing the contained composition and/or resolving any phase separation that may have occurred inside the container.

The process may include providing a fabric treatment composition to a receiving vessel, where the fabric treatment composition is provided, for example as a foam, with a density of from about 0.05 to about 0.5 g/mL, or from about 0.1 to about 0.4 g/mL, or from about 0.2 to about 0.3 g/mL, or about 0.25 g/mL. The process may include providing a fabric treatment composition to a receiving vessel, where the fabric treatment composition is provided, for example as a foam, with an FCA level of from about 0.01 to about 0.5 g FCA, or from about 0.02 to about 0.1 g FCA, or from about 0.03 to about 0.06 g FCA, per mL of composition.

The receiving vessel may be part of an automatic washing machine. The receiving vessel may be distinct from the main drum of the automatic washing machine, the main drum being where fabrics typically reside during a treatment cycle. The receiving vessel may be selectively insertable and/or removable from an automatic washing machine.

FIG. 1 shows a schematic drawing of a top-loading automatic washing machine 10. The machine includes a central-post agitator 11. The agitator 11 comprises a receiving vessel 12, typically in the form of a cup 13 or a cone at the top of the agitator 11. The fabric treatment composition 14 may be dispensed from a bottle 15 into the receiving vessel 12. During a treatment cycle, for example during the rinse cycle, of the top-loading automatic washing machine 10, the composition 14 may flow from the receiving vessel 12 into the drum 16 of the automatic washing machine 10 (as shown by arrows), where it may be diluted with and/or dissolved into water to form a treatment liquor 25.

Figure 2:
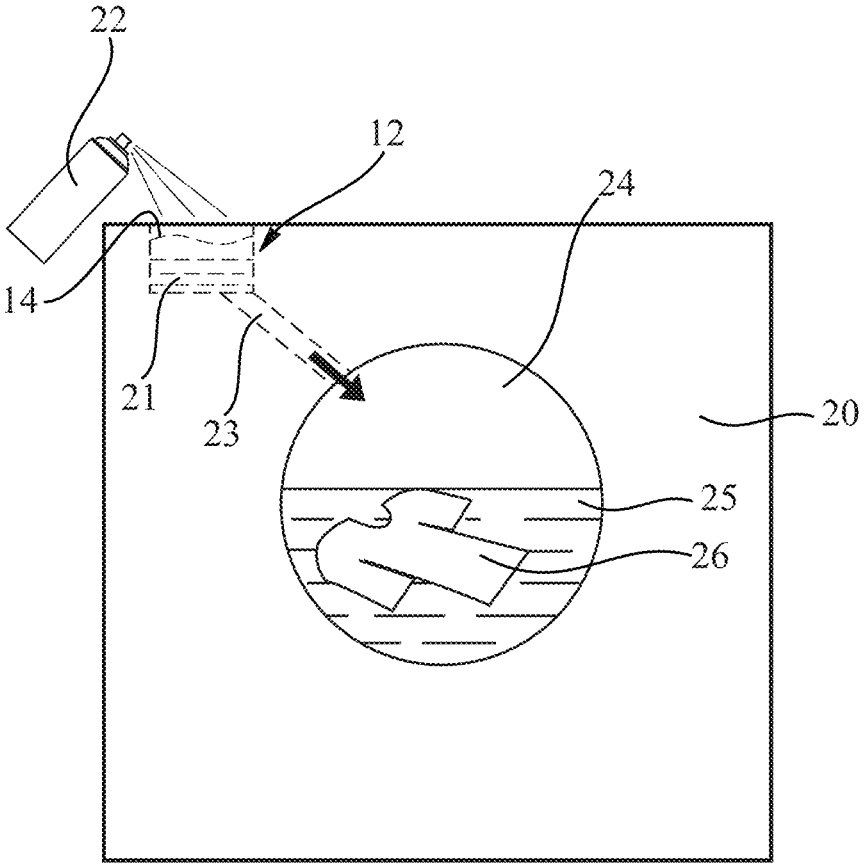
FIG. 2 shows a schematic drawing of a front-loading automatic washing machine.

FIG. 2 shows a schematic drawing of a front-loading automatic washing machine 20. The machine includes a receiving vessel 12 in the form of a dispensing drawer 21. The fabric treatment composition 14 may be dispensed from a bottle 22 into the receiving vessel 12. During a treatment cycle, for example during the rinse cycle, of the front-loading automatic washing machine 20, the composition 14 may flow from the receiving vessel 12 through a channel 23 into the drum 24 of the automatic washing machine 20. The fabric treatment composition 14 may be diluted with and/or dissolved into water to form a treatment liquor 25 in the drum, where it can contact a fabric 26.

Figure 3:
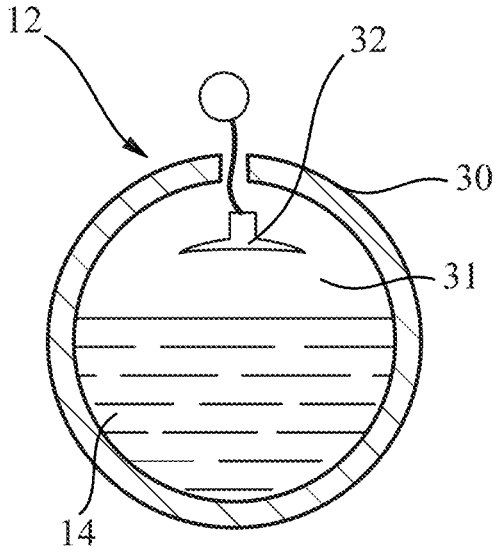
FIG. 3 shows a delivery device.

FIG. 3 shows a drawing of a receiving vessel 12 in the form of a removeably insertable delivery device 30. A fabric treatment composition 14 may be provided to the receiving volume 31 of the delivery device 30. The delivery device 30 may include a closure 32, for example in the form of a plug. The delivery device 30 may be placed into the drum 16, 24 of an automatic washing machine 10, 20, where the composition 14 may flow out of the delivery device 30 and mix with water to form a treatment liquor 25. Suitable delivery devices may include a DOWNY BALL® as made or licensed by The Procter & Gamble Company.

The receiving vessel may be a cap or closure to a container, for example to the container of the fabric treatment composition. The cap or closure may be provided to the drum 16, 24 of an automatic washing machine 10, 20.

The receiving vessel may comprise a receiving volume of from about 10 mL, or from about 25 mL, or from about 50 mL, to about 500 mL, or to about 350 mL, or to about 250 mL, or to about 200 mL, or to about 150 mL, or to about 125 mL, or to about 100 mL. 10 mL to about 500 mL, preferably from about 25 mL to about 350 mL, more preferably from about 50 mL to about 150 mL.

The process may include providing from about 5 g, or from about 10 g, or from about 15 g, or from about 18 g, to about 50 g, or to about 40 g, or to about 30 g, or to about 25 g, or to about 22 g, of the fabric treatment composition to the receiving vessel.

The fabric treatment composition may be dispensed from the container at a flow rate of from about 1 g/sec, or from about 2 g/sec, or from about 3 g/sec, or from about 4 g/sec or from about 5 g/sec, to about 35 g/sec, or to about 30 g/sec, or to about 25 g/sec, or to about 20 g/sec, or to about 15 g/sec, or to about 12 g/sec, or to about 10 g/sec, or to about 8 g/sec, or to about 6 g/sec. It may be preferred to select a flow rate that delivers about 20 g of composition over about 2 to about 6 seconds, preferably about 3 to about 5 seconds. The fabric composition may be dispensed from the container for a period of from about 1 second to about 10 seconds, preferably from about 2 seconds to about 6 seconds, more preferably from about 3 seconds to about 5 seconds. The composition may have a flow rate of from about 2 mL/sec to about 50 mL/sec, or from about 5 mL/sec to about 40 mL/sec, or from about 10 mL/sec to about 20 mL/sec.

Slower flow rates and/or shorter time periods may lead to the user becoming impatient and stopping the dispensation process before a suitable amount of active is delivered to the receiving vessel. Greater flow rates and or shorter time periods may lead to splashing, sub-optimal filling of the receiving vessel (e.g., under- or overflow), and/or other difficulties in controlling the dispensation process.

The fabric treatment composition, immediately after dispensing from the container, may be in the form of a foam, which may have a density of from 0.05 to about 0.5 g/mL, or from about 0.1 to about 0.4 g/mL, or from about 0.2 to about 0.3 g/mL, or about 0.25 g/mL. Greater densities may be more likely to spill or splash, similar to a liquid. Foams having lesser densities may not provide a suitable amount of active ingredient(s), given the limited volume of the receiving vessel.

When the fabric treatment composition is dispensed as a foam, the foam may "collapse" over time as gas is lost from the foam. With such collapse, the volume may decrease, and/or the density may increase. Such foam collapse may be desirable in the present methods, as the composition may have a desirable volume and/or density when dispensed, so that splashing and spills is minimized and/or the amount of active ingredient delivered by the foam is appropriate given the size of the receiving vessel; however, upon collapse, the composition may be more flowable and may more efficiently be provided to the drum of the washing machine and/or be more easily dilutable.

For example, the foam's volume may decrease by at least about 50% within ten minutes, or within five minutes, after being dispensed. The foam's density may increase by at least about 50% within ten minutes, or within five minutes, after being dispensed. The fabric treatment composition may have a first density of from about 0.05 to about 0.5 g/mL when initially dispensed, and a second density of from about 0.6 g/mL to about 1.1 g/mL about ten minutes, or about five minutes, after being dispensed. Preferably, the foam collapses to a near-water-like consistency or at least to that of traditional liquid fabric enhancer products, for example, having a density of from about 0.85 g/mL to about 1.0 g/mL, preferably within 10 minutes after being dispensed, more preferably within 5 minutes after being dispensed.

The fabric treatment composition may have a first viscosity when initially dispensed, and a second viscosity ten minutes after being dispensed. The second viscosity is typically less than the first viscosity. Such a viscosity profile over time may be preferred so that the composition may be relatively thick when initially dispensed into a receiving vessel, and thus relatively disinclined to splash. However, a second viscosity that is lower than the first viscosity indicates that the composition is relatively more flowable than when initially dispensed, meaning that it will be easier to dispense from the receiving vessel to the drum of an automatic washing machine and/or disperse or dissolve to form a treatment liquor. The first viscosity may be from about 250 to about 20,000 cps, preferably from about 250 to about 1000 cps, more preferably from about 250 to about 500 cps. The second viscosity may be from about 50 cps to about 250 cps. Viscosity of foam is measured using a Brookfield bob-in-cup rheometer at about 22° C.

The fabric treatment composition, immediately after dispensing from the container, may include from about 0.01 to about 0.5 g FCA, or from about 0.02 to about 0.1 g FCA, or from about 0.03 to about 0.06 g FCA, per mL of composition, which may be in the form of a foam.

When the composition is provided to the receiving vessel, the amount of FCA provided to the vessel may be from about 0.5 g to about 20 g, or from about 1 g to about 10 g, or from about 2 g to about 8 g, or from about 3 g to about 6 g. It is desirable to provide a sufficient amount of FCA to the receiving vessel, so that a sufficient amount is in turn provided to the drum of the machine to treat the target fabrics.

The process may include the step of providing the fabric treatment product to the drum of an automatic washing machine. The fabric treatment product may be provided from the receiving vessel, such as the dispensing drawer, to the drum. Water may be provided to the receiving vessel. The treatment composition may be combined or diluted with water in the receiving vessel. Providing water to the receiving vessel and/or diluting the treatment composition can facilitate the transport of the treatment composition to the drum.

The process may include the step of combining the fabric treatment composition with water to form a treatment liquor. The water may be provided to the receiving vessel, to the drum, or both. The treatment liquor may have a volume of from about 5 L to about 100 L, or from about 10 L to about 80 L, or from about 20 L to about 70 L; as known to one of ordinary skill, the volume of the treatment liquor may vary by type of machine used (e.g., a traditional top loader, or a front-loading machine) and/or by geography. The treatment liquor may include from about 10 to about 500 ppm, or from about 20 to about 300 ppm, or from about 30 to about 200 ppm, or from about 50 to about 150 ppm of FCA. The treatment liquor may be formed by diluting about 10 to about 40 grams of fabric treatment composition with about 5 L to about 100 L, or from about 10 L to about 80 L, or from about 20 L to about 70 L, of water.

The process may include contacting fabrics located in the drum of the automatic washing machine with the treatment liquor. The process may include mechanically agitating the fabrics and/or the treatment liquor. The treatment liquor may be drained from the drum.

The step of contacting the fabrics with the treatment liquor may occur during a rinse cycle of treatment cycle. The treatment cycle may further comprise a wash cycle, which may occur prior to the rinse cycle. The wash cycle may include contacting the fabric with a detergent composition or a wash liquor that includes such a composition, which may include anionic surfactant and other detergent adjuncts; the wash liquor may be drained from the drum prior to the start of the rinse cycle. The wash liquor may comprise about 20 to about 500 ppm of anionic surfactant.

The treatment cycle may include more than one rinse cycle, for example two or three rinse cycles.

Fabric Treatment Composition

The present disclosure relates to fabric treatment compositions. The fabric treatment compositions may include a fabric conditioning active (FCA), as described in more detail below. Compositions comprising such agents are useful for providing various benefits to target fabrics, including softness, anti-wrinkle, anti-static, conditioning, anti-stretch, color and/or appearance benefits. Compositions according to the present disclosure may be particularly useful for providing softness and/or anti-wrinkle benefits. The compositions may be intended for use as rinse-added compositions.

The fabric treatment compositions may include a fabric conditioning active (FCA). The fabric treatment composition may further include a carrier, such as water, a deposition aid, a structurant, nonionic surfactant, perfume, or combinations thereof. When the fabric treatment composition is contained in a pressurized container, such as an aerosol, the composition may further comprise a propellant, as described in more detail below.

Fabric Conditioning Agents (FCAs)

The fabric treatment compositions of the present disclosure may include an FCA present at a level of from about 1% to about 100%, by weight of the composition. The fabric treatment composition may include from about 1%, or from about 2%, or from about 3%, to about 100%, or to about 75%, or to about 50%, or to about 40%, or to about 30%, or to about 25%, or to about 20%, or to about 15%, or to about 10%, by weight of the composition, of FCA. The fabric treatment composition may include from about 5% to about 30%, by weight of the composition, of FCA.

Fabric conditioning actives (FCAs) suitable for compositions of the present disclosure may include quaternary ammonium ester compounds, silicones, non-ester quaternary ammonium compounds, amines, fatty esters, sucrose esters, silicones, dispersible polyolefins, polysaccharides, fatty acids, softening or conditioning oils, polymer latexes, or combinations thereof.

The composition may include a quaternary ammonium ester compound, a silicone, or combinations thereof, preferably a combination. The combined total amount of quaternary ammonium ester compound and silicone may be from about 5% to about 70%, or from about 6% to about 50%, or from about 7% to about 40%, or from about 10% to about 30%, or from about 15% to about 25%, by weight of the composition. The composition may include a quaternary ammonium ester compound and silicone in a weight ratio of from about 1:10 to about 10:1, or from about 1:5 to about 5:1, or from about 1:3 to about 1:3, or from about 1:2 to about 2:1, or about 1:1.5 to about 1.5:1, or about 1:1.

The composition may contain mixtures of different types of FCAs. The compositions of the present disclosure may contain a certain FCA but be substantially free of others. For example, the composition may be free of quaternary ammonium ester compounds, silicones, or both. The composition may comprise quaternary ammonium ester compounds but be substantially free of silicone. The composition may comprise silicone but be substantially free of quaternary ammonium ester compounds.

FCAs are discussed in more detail below. The type and amount of FCA(s) may be selected for the target benefit to be delivered and/or the fabrics targeted for treatment.

1. Quaternary Ammonium Ester

The compositions of the present disclosure may comprise a quaternary ammonium ester compound as a fabric conditioning active. The quaternary ammonium ester compound (sometimes referred to as "ester quats") may be present at a level of from about 2% to about 40%, or from about 3% to about 25%, preferably from 4% to 18%, more preferably from 5% to 15%, by weight of the composition. Preferably, the iodine value (see Methods) of the parent fatty acid from which the quaternary ammonium fabric compound is formed is from 0 to about 90, or from about 10 to about 70, or from about 15 to about 50, or from about 18 to about 30. The iodine value may be from about 25 to 50, preferably from 30 to 48, more preferably from 32 to 45. Without being bound by theory, lower melting points resulting in easier processability of the FCA are obtained when the parent fatty acid from which the quaternary ammonium compound is formed is at least partially unsaturated. Especially double unsaturated fatty acids enable easy to process FCA's. In preferred liquid fabric softener compositions, the parent fatty acid from which the quaternary ammonium conditioning actives is formed comprises from 2.0% to 20.0%, preferably from 3.0% to 15.0%, more preferably from 4.0% to 15.0% of double unsaturated C18 chains ("C18:2") by weight of total fatty acid chains (see Methods). On the other hand, very high levels of unsaturated fatty acid chains are to be avoided to minimize malodour formation as a result of oxidation of the fabric softener composition over time.

The quaternary ammonium ester compound may be present at a level of from greater than 0% to about 30%, or from about 1% to about 25%, or from about 3% to about 20%, or from about 4.0% to 18%, more preferably from 4.5% to 15%, even more preferably from 5.0% to 12% by weight of the composition. The level of quaternary ammonium ester compound may depend of the desired concentration of total fabric conditioning active in the composition (diluted or concentrated composition) and of the presence or not of other FCAs. However, the risk on increasing viscosities over time is typically higher in fabric treatment compositions with higher FCA levels. On the other hand, at very high FCA levels, the viscosity may no longer be sufficiently controlled which renders the product unfit for use.

Suitable quaternary ammonium ester compounds include but are not limited to, materials selected from the group consisting of monoester quats, diester quats, triester quats and mixtures thereof. Preferably, the level of monoester quat is from 2.0% to 40.0%, the level of diester quat is from 40.0% to 98.0%, the level of triester quat is from 0.0% to 25.0% by weight of total quaternary ammonium ester compound.

The quaternary ammonium ester compound may comprise compounds of the following formula:

$$\{R^2_{(4-m)}—N+—[X—Y—R^1]_m\}A^-$$

wherein:

m is 1, 2 or 3 with proviso that the value of each m is identical;

each $R^1$ is independently hydrocarbyl, or branched hydrocarbyl group, preferably $R^1$ is linear, more preferably $R^1$ is partially unsaturated linear alkyl chain;

each $R^2$ is independently a $C_1$-$C_3$ alkyl or hydroxyalkyl group, preferably $R^2$ is selected from methyl, ethyl, propyl, hydroxyethyl, 2-hydroxypropyl, 1-methyl-2-hydroxyethyl, poly($C_2$-$C_3$ alkoxy), polyethoxy, benzyl;

each X is independently —$(CH_2)$n-, —$CH_2$—CH$(CH_3)$— or —CH—$(CH_3)$—$CH_2$— and each n is independently 1, 2, 3 or 4, preferably each n is 2;

each Y is independently —O—(O)C— or —C(O)—O—;

A- is independently selected from the group consisting of chloride, methyl sulfate, and ethyl sulfate, preferably $A^-$ is selected from the group consisting of chloride and methyl sulfate, more preferably A- is methyl sulfate;

with the proviso that when Y is —O—(O)C—, the sum of carbons in each $R^1$ is from 13 to 21, preferably from 13 to 19. Preferably, X is —$CH_2$—CH$(CH_3)$— or —CH—$(CH_3)$—$CH_2$— to improve the hydrolytic stability of the quaternary ammonium ester compound, and hence further improve the stability of the fabric treatment composition.

Examples of suitable quaternary ammonium ester compound are commercially available from Evonik under the tradename Rewoquat WE18, Rewoquat WE20, from Stepan under the tradename Stepantex GA90, Stepantex VK90, Stepantex VL90A.

2. Silicones

The fabric treatment composition may comprise FCA comprising silicone.

Suitable levels of silicone may comprise from about 0.1% to about 70%, or from about 0.3% to about 40%, or from about 0.5% to about 30%, alternatively from about 1% to about 20% by weight of the composition. Useful silicones can be any silicone-comprising compound. The silicone polymer may be selected from the group consisting of cyclic silicones, polydimethylsiloxanes, aminosilicones, cationic silicones, silicone polyethers, silicone resins, silicone urethanes, and mixtures thereof. The silicone may comprise a polydialkylsilicone, such as a polydimethyl silicone (polydimethyl siloxane or "PDMS"), or a derivative thereof. The silicone may comprise an aminofunctional silicone, amino-polyether silicone, alkyloxylated silicone, cationic silicone, ethoxylated silicone, propoxylated silicone, ethoxylated/propoxylated silicone, quaternary silicone, or combinations thereof. The silicone may comprise a polydimethyl silicone, an aminosilicone, or a combination thereof, preferably an aminosilicone.

The silicone may comprise a random or blocky organosilicone polymer. The silicone may be provided as an emulsion.

The silicone may be characterized by a relatively high molecular weight. A suitable way to describe the molecular weight of a silicone includes describing its viscosity. A high molecular weight silicone may be one having a viscosity of from about 10 cSt to about 3,000,000 cSt, or from about 100 cSt to about 1,000,000 cSt, or from about 1,000 cSt to about 600,000 cSt, or even from about 6,000 cSt to about 300,000 cSt.

3. Non-Ester Quaternary Ammonium Compounds

Suitable non-ester quaternary ammonium compounds may comprise compounds of the formula:

$$[R_{(4-m)}—N^+—R^1_m]X^-$$

wherein each R comprises either hydrogen, a short chain $C_1$-$C_6$, in one aspect a $C_1$-$C_3$ alkyl or hydroxyalkyl group, for example methyl, ethyl, propyl, hydroxyethyl, poly($C_{2-3}$ alkoxy), polyethoxy, benzyl, or mixtures thereof; each m is 1, 2 or 3 with the proviso that the value of each m is the same; the sum of carbons in each $R^1$ may be $C_{12}$-$C_{22}$, with each $R^1$ being a hydrocarbyl, or substituted hydrocarbyl group; and $X^-$ may comprise any softener-compatible anion. The compounds may be formed from a parent fatty acid having an iodine value (see Methods) from 0 to about 90, or from about 10 to about 70, or from about 15 to about 50, or from about 18 to about 30. The iodine value may be from about 25 to 50, preferably from 30 to 48, more preferably from 32 to 45. The softener-compatible anion may comprise chloride, bromide, methylsulfate, ethylsulfate, sulfate, and nitrate. The softener-compatible anion may comprise chloride or methyl sulfate.

Non-limiting examples include dialkylenedimethylammonium salts such as dicanoladimethylammonium chloride, di(hard)tallowdimethylammonium chloride dicanoladimethylammonium methylsulfate, and mixtures thereof. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

4. Amines

Suitable amines include but are not limited to, materials selected from the group consisting of amidoesteramines, amidoamines, imidazoline amines, alkyl amines, and combinations thereof. Suitable ester amines include but are not limited to, materials selected from the group consisting of monoester amines, diester amines, triester amines and combinations thereof. Suitable amidoamines include but are not limited to, materials selected from the group consisting of monoamido amines, diamido amines and combinations thereof. Suitable alkyl amines include but are not limited to, materials selected from the group consisting of mono alkylamines, dialkyl amines quats, trialkyl amines, and combinations thereof.

5. Fatty Acid

The fabric treatment compositions of the present disclosure may comprise a fatty acid, such as a free fatty acid as FCA. The term "fatty acid" is used herein in the broadest sense to include unprotonated or protonated forms of a fatty acid. One skilled in the art will readily appreciate that the pH of an aqueous composition will dictate, in part, whether a fatty acid is protonated or unprotonated. The fatty acid may be in its unprotonated, or salt form, together with a counter ion, such as, but not limited to, calcium, magnesium, sodium, potassium, and the like. The term "free fatty acid" means a fatty acid that is not bound to another chemical moiety (covalently or otherwise).

The fatty acid may include those containing from 12 to 25, from 13 to 22, or even from 16 to 20, total carbon atoms, with the fatty moiety containing from 10 to 22, from 12 to 18, or even from 14 (mid-cut) to 18 carbon atoms.

The fatty acids may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, castor oil, etc.; (3) processed and/or bodied oils, such as linseed oil or tung oil via thermal, pressure, alkali-isomerization and catalytic treatments; (4) combinations thereof, to yield saturated (e.g. stearic acid), unsaturated (e.g. oleic acid), polyunsaturated (linoleic acid), branched (e.g. isostearic acid) or cyclic (e.g. saturated or unsaturated □□ disubstituted cyclopentyl or cyclohexyl derivatives of polyunsaturated acids) fatty acids. Mixtures of fatty acids from different fat sources can be used.

The cis/trans ratio for the unsaturated fatty acids may be important, with the cis/trans ratio (of the C18:1 material) being from at least 1:1, at least 3:1, from 4:1 or even from 9:1 or higher.

Branched fatty acids such as isostearic acid are also suitable since they may be more stable with respect to oxidation and the resulting degradation of color and odor quality.

The fatty acid may have an iodine value from 0 to 140, from 50 to 120 or even from 85 to 105.

6. Polysaccharides

The fabric treatment compositions of the present disclosure may comprise a polysaccharide as an FCA, for example cationic starch. Suitable cationic starches are commercially available from Cerestar under the trade name C*BOND® and from National Starch and Chemical Company under the trade name CATO® 2A.

7. Sucrose Esters

The fabric treatment compositions may comprise a sucrose esters as an FCA. Sucrose esters are typically derived from sucrose and fatty acids. Sucrose ester is composed of a sucrose moiety having one or more of its hydroxyl groups esterified.

Sucrose is a disaccharide having the following formula:

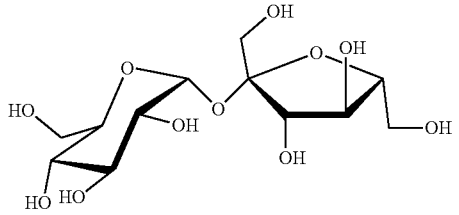

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the number of hydroxyl groups that are esterified, whereas (8-x) is the hydroxyl groups that remain unchanged; x is an integer selected from 1 to 8, alternatively from 2 to 8, alternatively from 3 to 8, or from 4 to 8; and $R^1$ moieties are independently selected from $C_1$-$C_{22}$ alkyl or $C_1$-$C_{30}$ alkoxy, linear or branched, cyclic or acyclic, saturated or unsaturated, substituted or unsubstituted.

The $R^1$ moieties may comprise linear alkyl or alkoxy moieties having independently selected and varying chain length. For example, $R^1$ may comprise a mixture of linear alkyl or alkoxy moieties wherein greater than 20% of the linear chains are $C_{18}$, alternatively greater than 50% of the linear chains are $C_{18}$, alternatively greater than 80% of the linear chains are $C_{18}$.

The $R^1$ moieties may comprise a mixture of saturate and unsaturated alkyl or alkoxy moieties. The iodine value of the sucrose esters suitable for use herein ranges from 1 to 150, or from 2 to 100, or from 5 to 85. The $R^1$ moieties may be hydrogenated to reduce the degree of unsaturation. In the case where a higher iodine value is preferred, such as from 40 to 95, then oleic acid and fatty acids derived from soybean oil and canola oil are suitable starting materials.

The unsaturated $R^1$ moieties may comprise a mixture of "cis" and "trans" forms the unsaturated sites. The "cis"/"trans" ratios may range from 1:1 to 50:1, or from 2:1 to 40:1, or from 3:1 to 30:1, or from 4:1 to 20:1.

8. Dispersible Polyolefins and Latexes

The fabric treatment compositions of the present disclosure may comprise a dispersible polyolefin as FCA. The polyolefins can be in the form of waxes, emulsions, dispersions or suspensions.

The polyolefin may be chosen from a polyethylene, polypropylene, or combinations thereof. The polyolefin may be at least partially modified to contain various functional groups, such as carboxyl, alkylamide, sulfonic acid or amide groups. The polyolefin may be at least partially carboxyl modified or, in other words, oxidized.

Non-limiting examples of fabric conditioning active include dispersible polyethylene and polymer latexes. These agents can be in the form of emulsions, latexes, dispersions, suspensions, and the like. In one aspect, they are in the form of an emulsion or a latex. Dispersible polyethylenes and polymer latexes can have a wide range of particle size diameters ($\chi_{50}$) including but not limited to from 1 nm to 100 μm; alternatively from 10 nm to 10 μm. As such, the particle sizes of dispersible polyethylenes and polymer latexes are generally, but without limitation, smaller than silicones or other fatty oils.

Generally, any surfactant suitable for making polymer emulsions or emulsion polymerizations of polymer latexes can be used as emulsifiers for polymer emulsions and latexes used as fabric softeners active in the present invention. Suitable surfactants include anionic, cationic, and non-ionic surfactants, and combinations thereof. In one aspect, such surfactants are non-ionic and/or anionic surfactants. In one aspect, the ratio of surfactant to polymer in the fabric conditioning active is 1:5, respectively.

Other Ingredients

The fabric treatment compositions of the present disclosure may include a deposition aid. Deposition aids can facilitate deposition of FCAs, perfumes, encapsulated benefit agents, or combinations thereof, improving the performance benefits of the treatment compositions and/or allow for more efficient formulation of such benefit agents. The composition may comprise, by weight of the composition, from 0.0001% to 3%, preferably from 0.0005% to 2%, more preferably from 0.001% to 1%, or from about 0.01% to about 0.5%, or from about 0.05% to about 0.3%, of a deposition aid. It may be desirable to limit the amount of deposition aid, particularly if the deposition aid is a cationic polymer, as it is believed that such materials can inhibit foam collapse and lead to a decrease in dispensing efficiency from the receiving vessel to a washing machine drum. The deposition aid may be a cationic or amphoteric polymer, preferably a cationic polymer.

Cationic polymers in general and their method of manufacture are known in the literature. Suitable cationic polymers may include quaternary ammonium polymers known the "Polyquaternium" polymers, as designated by the International Nomenclature for Cosmetic Ingredients, such as Polyquaternium-6 (poly(diallyldimethylammonium chloride), Polyquaternium-7 (copolymer of acrylamide and diallyldimethylammonium chloride), Polyquaternium-10 (quaternized hydroxyethyl cellulose), Polyquaternium-22 (copolymer of acrylic acid and diallyldimethylammonium chloride), and the like.

The deposition aid may be selected from the group consisting of polyvinylformamide, partially hydroxylated polyvinylformamide, polyvinylamine, polyethylene imine, ethoxylated polyethylene imine, polyvinylalcohol, polyacrylates, and combinations thereof. The cationic polymer may comprise a cationic acrylate.

Deposition aids can be added concomitantly with particles (at the same time with, e.g., encapsulated benefit agents) or directly/independently in the fabric treatment composition. The weight-average molecular weight of the polymer may be from 500 to 5000000 or from 1000 to 2000000 or from 2500 to 1500000 Dalton, as determined by size exclusion chromatography relative to polyethyleneoxide standards using Refractive Index (RI) detection. The weight-average molecular weight of the cationic polymer may be from 5000 to 37500 Dalton.

The fabric treatment compositions of the present disclosure may include a structurant. Structurants may facilitate physical stability of the composition in a container, for example by suspending particles (e.g., of FCA droplets or encapsulated benefit agents) and/or inhibiting agglomeration/aggregation of such materials.

Suitable structurants may include non-polymeric crystalline hydroxyl functional structurants, polymeric structuring agents, cellulosic fibers (for example, microfibrillated cellulose, which may be derived from a bacterial, fungal, or plant origin, including from wood), di-amido gellants, or combinations thereof.

Cellulosic fibers may be at least partially coated with a polymeric thickener. Non-polymeric crystalline, hydroxyl functional structurants may comprise a crystallizable glyceride which can be pre-emulsified to aid dispersion into the final fluid detergent composition. The crystallizable glycerides may include hydrogenated castor oil or "HCO" or derivatives thereof, provided that it is capable of crystallizing in the liquid detergent composition.

Polymeric structuring agents may be naturally derived and/or synthetically derived. Naturally derived polymeric structurants may comprise hydroxyethyl cellulose, hydrophobically modified hydroxyethyl cellulose, carboxymethyl cellulose, polysaccharide derivatives and mixtures thereof. Polysaccharide derivatives may comprise pectine, alginate, arabinogalactan (gum Arabic), carrageenan, gellan gum, xanthan gum, guar gum and mixtures thereof. Synthetic polymeric structurants may comprise polycarboxylates, polyacrylates, hydrophobically modified ethoxylated urethanes, hydrophobically modified non-ionic polyols and mixtures thereof. Polycarboxylate polymers may comprise a polyacrylate, polymethacrylate or mixtures thereof. Polyacrylates may comprise a copolymer of unsaturated mono- or di-carbonic acid and $C_1$-$C_{30}$ alkyl ester of the (meth) acrylic acid. Such copolymers are available from Noveon inc under the tradename Carbopol Aqua 30. Another suitable structurant is sold under the tradename Rheovis CDE, available from BASF.

When the fabric treatment composition (or product comprising such a composition) is intended to be shaken before use, a structurant may not be necessary, as such shaking may counteract any phase separation that has occurred during storage or between uses. In such cases, the fabric treatment composition may be substantially free of a structurant.

The fabric treatment compositions of the present disclosure may include a carrier. Suitable carriers may include be liquid carriers. Suitable carriers may include water, non-aqueous solvents, or a combination thereof.

The composition may include from about 1%, or from about 10%, or from about 25%, or from about 50%, to about 90%, or to about 85%, or to about 80%, or to about 75%, by weight of the composition, of water.

Non-aqueous solvents may include organic solvents, such as methanol, ethanol, propanol, isopropanol, 1,3-propanediol, 1,2-propanediol, ethylene glycol, glycerine, glycol ethers, hydrocarbons, or mixtures thereof. Other non-aqueous solvents may include lipophilic fluids such as siloxanes or other silicones, hydrocarbons, perfluorinated amines, perfluorinated and hydrofluoroether solvents, or mixtures thereof. Amine-containing solvents, such as monoethanolamine, diethanolamine and triethanolamine, may also be used.

The fabric treatment composition may include a source of ionic strength, such as a water-soluble salt, which may facilitate stabilization. Suitable salts may include alkali metal and/or alkali earth metal salts of halides, such as calcium chloride.

The fabric treatment compositions of the present disclosure may include perfume. The compositions may comprise from about 0.1% to about 10%, or from about 0.1% to about 5%, preferably from about 0.5% to about 4%, more preferably from about 1% to about 3%, by weight of the household care composition, of perfume. In some cases, it may be desirable for the composition to be relatively unscented. In such cases, no additional perfume is added, and the composition may comprise less than 0.1%, or even zero percent, of perfume.

Such perfume may be in the form of neat perfume, emulsified perfume, encapsulated perfume, or combinations thereof. The composition may further include a perfume delivery system.

As used herein, the term "perfume" encompasses the perfume raw materials (PRMs) and perfume accords. The term "perfume raw material" as used herein refers to compounds having a molecular weight of at least about 100 g/mol and which are useful in imparting an odor, fragrance, essence or scent, either alone or with other perfume raw materials. As used herein, the terms "perfume ingredient" and "perfume raw material" are interchangeable. The term "accord" as used herein refers to a mixture of two or more PRMs.

Typical PRM comprise inter alia alcohols, ketones, aldehydes, esters, ethers, nitrites and alkenes, such as terpene. A listing of common PRMs can be found in various reference sources, for example, "Perfume and Flavor Chemicals", Vols. I and II; Steffen Arctander Allured Pub. Co. (1994) and "Perfumes: Art, Science and Technology", Miller, P. M. and Lamparsky, D., Blackie Academic and Professional (1994).

The PRMs may be characterized by their boiling points (B.P.) measured at the normal pressure (760 mm Hg), and their octanol/water partitioning coefficient (P). Based on these characteristics, the PRMs may be categorized as Quadrant I, Quadrant II, Quadrant III, or Quadrant IV perfumes, as described in more detail below.

Octanol/water partitioning coefficient of a PRM is the ratio between its equilibrium concentration in octanol and in water. The log P of many PRMs has been reported; for example, the Pomona92 database, available from Daylight Chemical Information Systems, Inc. (Daylight CIS), Irvine, Calif., contains many, along with citations to the original literature. As used herein, the log P of a PRM is determined according to the Perfume Methods provided in the Test Methods section below.

The boiling points of many PRMs are given in, e.g., "Perfume and Flavor Chemicals (Aroma Chemicals)," S. Arctander, published by the author, 1969, incorporated herein by reference. Other boiling point values can be obtained from different chemistry handbooks and databases, such as the Beilstein Handbook, Lange's Handbook of Chemistry, and the CRC Handbook of Chemistry and Physics. When a boiling point is given only at a different pressure, usually lower pressure than the normal pressure of 760 mm Hg, the boiling point at normal pressure can be approximately estimated by using boiling point-pressure nomographs, such as those given in "The Chemist's Companion," A. J. Gordon and R. A. Ford, John Wiley & Sons Publishers, 1972, pp. 30-36.

Perfume raw materials having a B.P. lower than 250° C. and a Log P lower than 3.0 are called Quadrant I perfumes. Quadrant I perfumes having a B.P. lower than 250° C. and a Log P between 0 and 3.0 are preferred. Non-limiting examples of Quadrant I perfume raw materials include Allyl Caproate, Arnyl Acetate, Arnyl Propionate, Anisic Aldehyde, Anisole, Benzaldehyde, Benzyl Acetate, Benzyl Acetone, Benzyl Alcohol, Benzyl Formate, Benzyl Iso Valerate, Benzyl Propionate, Beta Gamma Hexenol, Camphor Gum, laevo-Carveol, d-Carvone, laevo-Carvone, Cinnamic Alcohol, Cinnamyl Formate, cis-Jasmone, cis-3-Hexenyl Acetate, Cuminic, alcohol, Cuminic aldehyde, Cyclal C, Dimethyl Benzyl Carbinol, Dimethyl Benzyl Carbinyl Acetate, Ethyl Acetate, Ethyl Aceto Acetate, Ethyl Amyl Ketone, Ethyl Benzoate, Ethyl Butyrate, Ethyl Hexyl Ketone, Ethyl Phenyl Acetate, Eucalyptol, Eugenol, Fenchyl Alcohol, Flor Acetate (tricyclo Decenyl Acetate), Frutene (tricyclo Decenyl Propionate), Geraniol, Hexenol, Hexenyl Acetate, Hexyl Acetate, Hexyl Formate, Hydratropic Alcohol, Hydroxycitronellal, Isoamyl Alcohol, Isomenthone, Isopulegyl Acetate, Isoquinoline, cis jasmone, Ligustral, Linalool, Linalool Oxide, Linalyl Formate, Menthone, Methyl Acetophenone, Methyl Arnyl Ketone, Methyl Anthranilate, Methyl Benzoate, Methyl Benzyl Acetate, nerol, phenyl ethyl alcohol, alpha-terpineol, Propanoic acid ethyl ester, Ethyl Propionate, Acetic acid 2-methylpropyl ester, Isobutyl Acetate, Butanoic acid 2-methyl-ethyl ester, Ethyl-2-Methyl Butyrate, 2-Hexenal, (E)-, 2-Hexena,l Benzeneacetic acid methyl ester, Methyl Phenyl Acetate, 1,3-Dioxolane-2-acetic acid 2-methyl-ethyl ester, Fructone, Benzeneacetaldehyde.alpha.-methyl-, Hydratropic Aldehyde, Acetic acid (2-methylbutoxy)-2-propenyl ester, Allyl Amyl Glycolate, Ethanol 2,2'-oxybis-, Calone 161, 2(3H)-Furanone 5-ethyldihydro-, Gamma Hexalactone, 2H-Pyran 3,6-dihydro-4-methyl-2-(2-methyl-1-propenyl)-, Nerol Oxide, 2-Propenal 3-phenyl-, Cinnamic Aldehyde, 2-Propenoic acid 3-phenyl-methyl ester, Methyl Cinnamate, 4H-Pyran-4-one 2-ethyl-3-hydroxy-, Ethyl Maltol, 2-Heptanone, Methyl Amyl Ketone, Acetic acid pentyl ester, Iso Amyl-Acetate, Heptenone methyl-, Methyl Heptenone, 1-Heptanol, Heptyl Alcohol, 5-Hepten-2-one 6-methyl-, Methyl Heptenone, Ethanol 2-(2-methoxyethoxy)-, Veramoss Sps, Tricyclo[2.2.1.02,6]heptane 1-ethyl-3-methoxy-, Neoproxen, Benzene 1,4-dimethoxy-, Hydroquinone Dimethyl Ether, Carbonic acid 3-hexenyl methyl ester (Z)-, Liffarome, Oxirane 2,2-dimethyl-3-(3-methyl-2,4-pentadienyl)-, Myroxide, Ethanol 2-(2-ethoxyethoxy)-, Diethylene Glycol Mono Ethylether, Cyclohexaneethanol, Cyclohexyl Ethyl Alcohol, 3-Octen-1-ol (Z)-, Octenol Dix, 3-Cyclohexene-1-carboxaldehyde 3,6-dimethyl-, Cyclovertal, 1,3-Oxathiane 2-methyl-4-propyl-cis-, Oxane, Acetic acid 4-methylphenyl ester, Para Cresyl Acetate, Benzene (2,2-dimethoxyethyl)-, Phenyl Acetaldehyde Dimethyl Acetal, Octanal 7-methoxy-3,7-dimethyl-, Methoxycitronellal Pq, 2H-1-Benzopyran-2-one octahydro-, Octahydro Coumarin, Benzenepropanal.beta.-methyl-, Trifemal, 4,7-Methano-1H-indenecarboxaldehyde octahydro-, Formyltricyclodecan, Ethanone 1-(4-methoxyphenyl)-, Para Methoxy Acetophenone, Propanenitrile 3-(3-hexenyloxy)-(Z)-, Parmanyl, 1,4-Methanonaphthalen-5(1H)-one 4,4a,6,7,8,8a-hexahydro-, Tamisone, Benzene [2-(2-propenyloxy)ethyl]-, LRA 220, Benzenepropanol, Phenyl Propyl Alcohol, 1H-Indole, Indole, 1,3-Dioxolane 2-(phenylmethyl)-, Ethylene Glycol Acetal/Phenyl Acetaldehyde, 2H-1-Benzopyran-2-one 3,4-dihydro-, Dihydrocoumarin, and mixtures thereof.

Perfume raw materials having a B.P. of about 250° C. or higher and a Log P lower than 3.0 are called Quadrant II perfumes. Quadrant II perfumes having a B.P. higher than 250° C. and a Log P between 0 and 3.0 are preferred. Non-limiting examples of Quadrant II perfume raw materials include coumarin, eugenol, iso-eugenol, indole, methyl cinnamate, methyl dihydrojasmonate, methyl-N-methyl anthranilate, beta-methyl naphthyl ketone, delta-Nnonalactone, vanillin, and mixtures thereof.

Perfume raw materials having a B.P. less than 250° C. and a Log P higher than about 3.0 are called Quadrant III perfumes. Non-limiting examples of Quadrant III perfume raw materials include iso-bomyl acetate, carvacrol, alpha-citronellol, paracymene, dihydro myrcenol, geranyl acetate, d-limonene, linalyl acetate, vertenex.

Perfume raw materials having a B.P. of about 250° C. or higher and a Log P of about 3.0 or higher are called Quadrant IV perfumes or enduring perfumes. Non-limiting examples of enduring perfume raw materials include allyl cyclohexane propionate, ambrettolide, amyl benzoate, amyl cinnamate, amyl cinnamic aldehyde, amyl cinnamic aldehyde dimethyl acetal, iso-amyl salicylate, hydroxycitronellal-methyl anthranilate (known as Aurantiol®), benzophenone, benzyl salicylate, para-tert-butyl cyclohexyl acetate, iso-butyl quinoline, beta-caryophyllene, cadinene, cedrol, cedryl acetate, cedryl formate, cinnamyl cinnamate, cyclohexyl salicylate, cyclamen aldehyde, dihydro isojasmonate, diphenyl methane, diphenyl oxide, dodecalactone, 1-(1,2,3,4,5,6,7,8-octahydro-2,3,8,8-tetramethyl-2-naphthalenyl)-ethanone (known as iso E super®), ethylene brassylate, methyl phenyl glycidate, ethyl undecylenate, 15-hydroxypentadecanoic acid lactone (known as Exaltolide®), 1,3,4,6,7,8-hexahydro-4,6,6,7,8,8-hexamethyl-cyclopenta-gamma-2-benzopyran (known as Galaxolide®), geranyl anthranilate, geranyl phenyl acetate, hexadecanolide, hexenyl salicylate, hexyl cinnamic aldehyde, hexyl salicylate, alpha-irone, gamma-ionone, gamma-n-methyl ionone, para-tertiary-butyl-alpha-methyl hydrocinnamic aldehyde (known as Lilial®), Lilial (p-t-bucinal)®, linalyl benzoate, 2-methoxy naphthalene, methyl dihydrojasmone, musk indanone, musk ketone, musk tibetine, myristicin, oxahexadecanolide-10, oxahexadecanolide-11, patchouli alcohol, 5-acetyl-1,1,2,3,3,6-hexamethylindan (known as Phantolide®), phenyl ethyl benzoate, phenylethylphenylacetate, phenyl heptanol, phenyl hexanol, alpha-santalol, delta-undecalactone, gamma-undecalactone, vetiveryl acetate, yara-yara, ylangene.

The perfume raw materials and accords may be obtained from one or more of the following perfume material suppliers Firmenich (Geneva, Switzerland), Givaudan (Argenteuil, France), IFF (Hazlet, N.J.), Quest (Mount Olive, N.J.), Bedoukian (Danbury, Conn.), Sigma Aldrich (St. Louis, Mo.), Millennium Specialty Chemicals (Olympia Fields, Ill.), Polarone International (Jersey City, N.J.), Fragrance Resources (Keyport, N.J.), and Aroma & Flavor Specialties (Danbury, Conn.).

Traditionally, perfume accords are formulated around "enduring" perfumes (Quadrant IV) due to their high deposition efficiency hence odor impact on fabrics, while "non-enduring" perfumes, especially Quadrant I perfume ingredients, are considered difficult to deposit onto fabrics and as such typically are used solely in very low amount to minimize waste and pollution. Quadrant I perfume ingredients are hydrophilic (e.g., a Log P lower than 3.0) and have low boiling points (e.g., a B.P. lower than 250° C.); thus, they are easily lost to the wash or rinse medium or during heat drying.

That being said, some non-enduring perfume ingredients, especially Quadrant I perfume ingredients, may be intentionally formulated into the fabric treatment compositions of the present disclosure. Without wishing to be bound by theory, it is believed that such non-enduring perfume ingredients, especially Quadrant I perfume ingredients, will be released into the air upon dispensing the compositions of the present disclosure as intended. It is believed that such release will provide a pleasant burst of scent to the immediate room, thereby transforming the otherwise dreary task of laundry into a more enjoyable experience to the user.

Thus, compositions of the present disclosure may comprise perfume, wherein the perfume comprises: (i) from about 15% to about 60%, preferably from about 20% to about 55%, more preferably from about 25% to about 50%, by weight of the perfume, of non-enduring perfume ingredients; (ii) from about 2% to about 15%, preferably from about 3% to about 12%, more preferably from about 4% to about 10% by weight of the perfume accord of Quadrant I perfume ingredients; (iii) at least about 2%, or at least about 3%, or at least about 4%, by weight of the composition, of Quadrant I perfume ingredients; or (iv) combinations thereof. As described above, non-enduring perfume ingredients encompass Quadrant I, II and III perfume ingredients.

Additionally or alternatively, the perfume may include from about 2.5% to about 25%, preferably from about 3% to about 20%, more preferably from about 5% to about 15% of Quadrant II perfume ingredients, from about 10% to about 50%, preferably from about 15% to about 45%, more preferably from about 20% to about 40% of Quadrant III perfume ingredients, and/or from about 40% to about 85%, preferably from about 45% to about 75%, more preferably from about 40% to about 65% of Quadrant IV perfume ingredients. It is believed that such perfumes can provide good perfume performance at the time of dispensing the composition from the container, while still delivering efficient perfume on fabrics deposition through the wash.

The encapsulated perfume may be formed by at least partially surrounding perfume materials with a wall material. The capsule wall material may comprise: melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol, or mixtures thereof. The melamine wall material may comprise melamine crosslinked with formaldehyde, melamine-dimethoxyethanol crosslinked with formaldehyde, and mixtures thereof. The polyacrylate based wall materials may comprise polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer, and mixtures thereof.

The perfume capsule may be coated with a deposition aid, a cationic polymer, a non-ionic polymer, an anionic polymer, or mixtures thereof. Suitable polymers may be selected from the group consisting of: polyvinylformaldehyde, partially hydroxylated polyvinylformaldehyde, polyvinylamine, polyethyleneimine, ethoxylated polyethyleneimine, polyvinylalcohol, polyacrylates, a polysaccharide (e.g., chitosan), and combinations thereof.

One or more types of encapsulates, for examples two encapsulate types, wherein one of the first or second encapsulates (a) has a wall made of a different wall material than the other; (b) has a wall that includes a different amount of wall material or monomer than the other; or (c) contains a different amount perfume oil ingredient than the other, or (d) contains a different perfume oil, may be used. Encapsulates may be added to the composition as a slurry.

The perfume delivery technology may comprise an amine compound (ARP) or a thio compound. One may also use "reactive" polymeric amines and or polymeric thios in which the amine and/or thio functionality is pre-reacted with one or more perfume raw materials (PRMs) to form a compound. Typically, the reactive amines are primary and/or secondary amines, and may be part of a polymer or a monomer (non-polymer). Such ARPs may also be mixed with additional PRMs to provide benefits of polymer-assisted delivery and/or amine-assisted delivery. Nonlimiting examples of polymeric amines include polymers based on polyalkylimines, such as polyethyleneimine (PEI), or polyvinylamine (PVAm). Nonlimiting examples of monomeric (non-polymeric) amines include hydroxyl amines, such as 2-aminoethanol and its alkyl substituted derivatives, and aromatic amines such as anthranilates. The benefit may include improved delivery of perfume and/or controlled perfume release.

The fabric treatment compositions of the present disclosure may include nonionic surfactant. Nonionic surfactants may facilitate dispersing perfume into the fabric treatment composition. Nonionic surfactants may also act as emulsification aids for certain FCAs, such as silicone. The composition may comprise, based on the total composition weight, from 0.01% to 10%, preferably from 0.01% to 5%, more preferably from 0.1% to 3.0%, most preferably from 0.5% to 2.0% of a nonionic surfactant. The nonionic surfactant may be an ethoxylated nonionic surfactant, preferably an ethoxylated nonionic surfactant having a hydrophobic lipophilic balance value of 8 to 18. The composition may comprise less than 0.1%, or even 0%, by weight of the composition, of nonionic surfactant.

Examples of suitable nonionic surfactants are commercially available from BASF under the tradename Lutensol AT80 (ethoxylated alcohol with an average degree of ethoxylation of 80 from BASF), from Clariant under the tradename Genapol T680 (ethoxylated alcohol with an average degree of ethoxylation of 68), from Sigma Aldrich under the tradename Tween 20 (polysorbate with an average degree of ethoxylation of 20).

The fabric treatment composition may have a neat pH of from about 2, or from about 3, to about 7, or to about 6, or to about 5, or to about 4, preferably a pH of from about 2 to about 3.7, more preferably a pH from about 2 to about 3.5, preferably in the form of an aqueous liquid. The pH may be selected to facilitate stability of the FCA. For example, a treatment composition comprising quaternary ammonium ester compounds may have a neat pH of from about 2 to about 4, or from about 2.5 to about 3.5. The fabric treatment compositions of the present disclosure may include pH modifiers and/or buffers, such as hydroxides (e.g., NaOH), amines such as alkanolamines, strong acids (e.g., HCl) and/or organic acids (e.g., citric acid, formic acid).

The fabric treatment composition may include a colorant, such as a dye, preferably a non-fabric-substantive dye (e.g., an aesthetic dye). The color of the composition may visually contrast with the receiving vessel, making it easier to see when the composition reaches an appropriate dosing or volumetric mark of the receiving vessel. Compositions having such colorants may also be aesthetically pleasing.

The fabric treatment composition may include additional processing, stability, or performance aids, such as chelant (e.g., DTPA or HEDP), preservatives, suds suppressors, or other suitable agents.

The fabric treatment composition may be substantially free of certain surfactants, particularly anionic surfactants, as anionic surfactants may negatively interact with the FCAs, leading to poor stability and/or performance. By "substantially free," it is meant herein that the fabric treatment compositions may comprise less than 1%, or less than 0.5%, or less than 0.1%, or even 0%, by weight of the composition, of anionic surfactant. It may be that no anionic surfactant is intentionally added, although it is possible (although not preferred) that trace amounts enter the compositions as impurities or carriers of other (intentionally added) ingredients. Anionic surfactants may include anionic sulphonate surfactants such as linear alkyl benzene sulphonate (LAS), sulfated surfactants such as alkoxylated and/or non-alkoxylated sulfate surfactants, or mixtures thereof. Anionic surfactants may be linear or branched.

The fabric treatment composition may be substantially free of bleach, as bleach may degrade the FCA and/or perfumes of the composition. By "substantially free," it is meant herein that the fabric treatment compositions may comprise less than 1%, or less than 0.5%, or less than 0.1%, or even 0%, by weight of the composition, of bleach. Bleaches may include photobleaches, bleach activators, hydrogen peroxide, sources of hydrogen peroxide, preformed peracids, hypochlorite-type bleaches, or mixtures thereof. The composition may also be substantially free of bleach catalysts, bleach activators (e.g, NOBS or TAED), and/or other ingredients that may be present in a bleaching system.

Fabric Treatment Product

The fabric treatment composition may be provided as part of a fabric treatment product, where the product comprises a container that contains the fabric treatment composition.

The container may comprise the fabric treatment composition in an internal volume of the container. The internal volume of the container may be from about 25 mL to about 1 L, or from about 50 mL to about 750 mL, or from about 100 mL to about 500 mL, or from about 200 mL to about 350 mL. The container may comprise from about 25 g to about 1000 g, or from about 50 g to about 750 g, or from about 100 g to about 500 g, or from about 200 g to about 350 g of the fabric treatment composition. Relatively smaller volumes and/or masses may be preferred so that the container is more easily manipulated by a user. The container may comprise a reservoir, which may be removeable.

The container may be any container that can suitably dispense fabric treatment composition in the densities provided above, e.g., as a foam. The container may comprise a mechanically actuated pump, such as a trigger sprayer, or it may be a pressurized container, such as an aerosol sprayer. A pressurized container may be preferred for convenient dispensing the composition as a foam.

Containers according to the present disclosure may include a dip tube, which may allow for upright dispensing. However, such containers may be less preferred, as the dip tube may become blocked by the compositions of the present disclosure. Therefore, the container may be free of a dip tube.

The container may be made of any suitable material, including plastic, metal, alloy and/or metal, such as aluminum. A plastic container, including an all-plastic may be preferred for recycling reasons. The plastic may be polymeric and may be partially, substantially, or entirely comprised of polyester; polyethyleneterephthalate ("PET"); polyethylene napthalate, polyethylene furanoate, polyamide; nylon 6/6, nylon 66, nylon 11, polycarbonate; polyoxymethylene; polyacrylonitrile; polyolefin; polyethylene, polypropylene, fluoropolymer; poly(butylene succinate); virgin, recycled, and regrind versions of the other polymer materials; bio-based and petroleum-based versions of the other polymer materials; or mixtures thereof. A metal container, such as an aluminum container may be used.

The container may include layers of material. For example, the container may include an interior liner or coating, which may be selected to improve compatibility of the container with the fabric treatment composition. For example, the container may include a liner of a different material, such as a polyamide imide (PAM) liner. Such liners may be compatible with compositions having a wide-range of pH, including acidic pH, and/or may help to prevent corrosion of the metal container.

The container may be of the bag-on-valve type, wherein the container comprises an inner bag and an outer container, which encloses the inner bag, while the inner bag has a valve mechanism attached which is movable between an open position and a closed position. The outer container may be formed from metal or plastic or the like, and any of the propellants described herein can be filled in a space between the outer container and the inner bag. The inner bag may be flexible, and can be made from a single material or from a composite material including plastic, which may comprise at least a polymeric layer and a layer which acts as a gas barrier, e.g., made from metal, such as aluminum. The inner material of the bag may be inert to the contents of the composition, and the inner material may also be impenetrable by the contents of the composition in the bag. The inner bag may comprise a layer of a material which is essentially impermeable to the propellant inside of the bag. The inner bag may comprise a layer of a material which is essentially impermeable to the propellant outside of the bag which generally is not intended to be mixed with the composition in the inner bag during storage. Such container types may be preferred for being able to deliver consistent product across the usage life of the container (e.g., from the first spray to the last spray), may be more suitable for use with a relatively viscous composition, and/or may help to protect a metal can from corrosion.

The container may include a valve through which the treatment composition exits the container when dispensed. The valve may include one or more exit openings of suitable size(s). The valve size and/or number may be selected to provide a desired flow rate. For example, the valve may include one, two, three, or four openings. The openings may have a diameter of from about 0.010 inches to about 0.1 inches, or from about 0.020 inches to about 0.050 inches. The valve may be selected so as to dispense the fabric treatment composition in a direction that is substantially parallel with a longitudinal axis of the container, or in a direction that is not substantially parallel with a longitudinal axis of the container, for example a direction that is substantially perpendicular to a longitudinal axis of the container.

When the container is a pressurized container, the fabric treatment composition, when contained in the container, may comprise a propellant. The fabric treatment composition may comprise from about 1% to about 12%, or from about 1.5% to about 6%, or from about 2% to about 4%, by weight of the fabric treatment composition, of the propellant. The amount and type of propellant may be selected, optionally in combination with a valve type, to provide a desired density of foam and/or flow rate when dispensed.

The propellant may comprise one or more volatile materials, which in a gaseous state, may carry the other components of the concentrated fabric treatment composition in particulate or droplet form. The propellant may have a boiling point within the range of from about −45° C. to about 5° C. The propellant may be liquefied when packaged in conventional aerosol containers under pressure. The rapid boiling of the propellant upon leaving the aerosol foam dispenser may aid in the formation of foam of the treatment composition when dispensed.

The propellant may be selected from any suitable propellant, or mixtures of propellants. Suitable propellants may include: hydrocarbons, such as chemically inert hydrocarbons; halogenated hydrocarbons such as hydrofluorocarbons (HFCs) and/or hydrofluoroolefins (HFOs); nitrogen; carbon dioxide; compressed air; or combinations thereof. Chemically inert hydrocarbons may include propane, n-butane, isobutane, cyclopropane, or mixtures thereof; isobutane, propane, and/or butane may be preferred for their low ozone reactivity. Halogenated hydrocarbons may include dichlorodifluoromethane, 1,1-dichloro-1,1,2,2-tetrafluoroethane, 1-chloro-1,1-difluoro-2,2-trifluoroethane, 1-chloro-1,1-difluoroethylene, 1,1-difluoroethane, dimethyl ether, monochlorodifluoromethane, trans-1,3,3,3-tetrafluoropropene, or mixtures thereof.

As chloroflurorocarbon (CFC) propellants are not preferred for environmental reasons, the propellant may comprise hydrofluorocarbons (HFCs), hydrofluoroolefins (HFOs), or combinations thereof. HFOs may be preferred for environmental and/or safety reasons. HFOs may also provide preferred aesthetics in the dispensed products, such as a shine that is believed to be consumer-preferred. Suitable HFO propellants may include: 1,3,3,3-tetrafluoropropene; 2,3,3,3-tetrafluoropropene; or combinations thereof. 1,3,3,3-tetrafluoropropene, also known as HFO-1234ze, may be preferred. Suitable HFO propellants are available under the SOLSTICE® trademark from Honeywell International, Inc. (New Jersey, USA).

The container may include a perfume or scent source that is independent of the fabric treatment composition. For example, the container may include a sticker, such as a scratch-and-sniff sticker, that releases perfume or other scent. The container may include a polymeric bead, glue, or other adhesive that that includes perfume and allows for the perfume's release. Such sources of perfume or other scent may be desirable signals to the consumer of the composition's scent, making the scent accessible without having to dispense the composition.

The container may include a selectively removeable cap. The cap may serve as a receiving vessel according to the present disclosure. The fabric treatment composition may be provided to the cap, and the filled cap may be provided to the drum of an automatic washing machine, where the composition may be diluted or dissolved in water to form a treatment liquor.

Process of Making

The compositions of the present disclosure may be made, and products according to the present disclosure may be assembled, according to processes known to one of ordinary skill in the art. For example, a fabric treatment composition may be made by combining ingredients at the desired levels according to known methods.

For example, the compositions disclosed herein may be prepared by combining the components thereof in any convenient order and by mixing, e.g., agitating, the resulting component combination to form a phase stable fabric and/or home care composition. A fluid matrix may be formed containing at least a major proportion, or even substantially all, of the fluid components with the fluid components being thoroughly admixed by imparting shear agitation to this liquid combination. For example, rapid stirring with a mechanical stirrer may be employed. It may be desirable to combine the FSA (e.g., an ester quat) and water, mix, and then add additional adjuncts as desired to the quat/water mixture.

The composition may be provided to a suitable bottle, placing a valve onto the bottle, and providing propellant to the bottle (for example, through a stem on the valve or under the valve cup) to pressurize the contents. The bottle may be shaken or otherwise agitated to mix.

Additionally or alternatively, a suitable liquid propellant may be provided to a base fabric treatment composition; the resulting mixture may be provided to a bottle and sealed. The propellant may then volatilize in the bottle and build up pressure.

Use of a Fabric Treatment Composition

The present disclosure relates to the use of a fabric treatment composition according to the present disclosure, where the composition provides an anti-wrinkle benefit to a fabric when the fabric is treated with a treatment liquor comprising water and the fabric treatment composition, for example according to the processes described herein. The composition may be dispensed, preferably as a foam, from a pressurized container.

Combinations

Specifically contemplated combinations of the disclosure are herein described in the following lettered paragraphs. These combinations are intended to be illustrative in nature and are not intended to be limiting.

A. A process of treating a fabric with a fabric treatment composition, the process comprising the steps of: a. providing a fabric treatment product, the product comprising a fabric treatment composition contained in a container, the fabric treatment composition comprising a fabric conditioning active (FCA); b. dispensing the fabric treatment composition from the container as a foam, wherein the foam is provided to a receiving vessel, wherein the vessel comprises a receiving volume of from about 10 mL to about 500 mL, preferably from about 25 mL to about 350 mL, more preferably from about 50 mL to about 150 mL; c. providing the fabric treatment composition to a drum of an automatic washing machine; d. combining the fabric treatment composition with water to form a treatment liquor; and e. contacting a fabric in the drum of the automatic washing machine with the treatment liquor.

B. A process according to paragraph A, wherein the composition as a foam has a density of from about 0.05 to about 0.5 g/mL, or from about 0.1 to about 0.4 g/mL or from about 0.1 to about 0.3 g/mL, or from about 0.2 to about 0.3 g/mL, as determined immediately after dispensing from the container.

C. A process according to any of paragraphs A or B, wherein the composition has a density of from about 0.6 g/mL to about 1.1 g/mL ten minutes after being dispensed.

D. A process according to any of paragraphs A-C, wherein the composition as a foam comprises from about 0.01 to about 0.5 g FCA, or from about 0.02 to about 0.1 g FCA, or from about 0.03 to about 0.06 g FCA per 1 mL of foam, determined immediately after the composition is dispensed from the container.

E. A process according to any of paragraphs A-D, wherein the composition provided to the receiving vessel provides about 0.5 g to about 20 g, or from about 1 g to about 10 g, or from about 2 g to about 8 g, or from about 3 g to about 6 g of FCA to the receiving vessel.

F. A process according to any of paragraphs A-E, wherein the receiving vessel is part of the automatic washing machine, preferably where the receiving vessel is a dispenser drawer or is located on the center post of a top-loading machine.

G. A process according to any of paragraphs A-F, wherein the container comprises a manually actuated pump or is a pressurized container, preferably wherein the container is a pressurized container.

H. A process according to any of paragraphs A-G, wherein the fabric treatment composition is dispensed from the container with a flow rate of from about from about 1 g/sec, or from about 2 g/sec, or from about 3 g/sec, or from about 4 g/sec or from about 5 g/sec, to about 35 g/sec, or to about 30 g/sec, or to about 25 g/sec, or to about 20 g/sec, or to about 15 g/sec, or to about 12 g/sec, or to about 10 g/sec, or to about 8 g/sec, or to about 6 g/sec.

I. A process according to any of paragraphs A-H, wherein the fabric treatment composition is dispensed from the container for a period of from about 1 second to about 10 seconds, preferably from about 2 seconds to about 6 seconds.

J. A process according to any of paragraphs A-I, wherein fabric treatment composition further comprises a propellant when in the container, preferably a propellant selected from hydrocarbons, hydrofluorocarbons (HFCs), hydrofluoroolefins (HFOs), nitrogen, carbon dioxide, compressed air, or combinations thereof, more preferably comprising an HFC, an HFO, or combinations thereof, even more preferably an HFO, even more preferably an HFO comprising 1,3,3,3-tetrafluoropropene.

K. A process according to any of paragraphs A-J, wherein the fabric treatment composition, when in the container, comprises from about 1% to about 12%, or from about 1.5% to about 6%, or from about 2% to about 4%, by weight of the fabric treatment composition, of a propellant.

L. A process according to any of paragraphs A-K, wherein the foam's initial volume decreases by at least 50% within ten minutes after being dispensed.

M. A process according any of paragraphs A-L, wherein the step of providing the treatment composition to the drum of the automatic washing machine comprises diluting the treatment composition with water in the receiving vessel.

N. A fabric treatment composition, the composition comprising a fabric conditioning active (FCA), the composition being contained in a container, wherein, immediately after being dispensed from the container, the composition is in the form of a foam having a density of from about 0.05 to about 0.5 g/mL, or from about 0.1 to about 0.4 g/mL, or from about 0.1 to about 0.3 g/mL, or from about 0.2 to about 0.3 g/mL.

O. A fabric treatment composition, the fabric treatment composition comprising a fabric conditioning active (FCA), the composition further comprising encapsulated perfume, wherein the fabric treatment composition is contained in a pressurized container.

P. A fabric treatment composition, the fabric treatment composition comprising a fabric conditioning active (FCA), the composition further comprising hydrofluoroolefin propellant, wherein the fabric treatment composition is contained in a pressurized container.

Q. A fabric treatment composition, the fabric treatment composition comprising a fabric conditioning active (FCA), the fabric treatment composition is contained in a pressurized container, wherein the fabric treatment composition is characterized by a first density of from about 0.05 to about 0.5 g/mL, or from about 0.1 to about 0.4 g/mL, or from about 0.1 to about 0.3 g/mL, or from about 0.2 to about 0.3 g/mL, as determined immediately after dispensing from the container, and a second density of from about 0.6 g/mL to about 1.1 g/mL, as determined ten minutes after being dispensed.

Q1. A fabric treatment composition according to any combination of paragraphs N-Q.

R. A fabric treatment composition according to any of paragraphs N-Q1, wherein the fabric treatment composition comprises from 1% to about 75%, by weight of the fabric care composition, of the FCA.

S. A fabric treatment composition according to any of paragraphs N-R, wherein the FCA is selected from the group consisting of quaternary ammonium ester compounds, silicones, non-ester quaternary ammonium compounds, amines, fatty esters, sucrose esters, silicones, dispersible polyolefins, polysaccharides, fatty acids, softening or conditioning oils, polymer latexes, or combinations thereof, preferably from quaternary ammonium ester compounds, silicones, or combinations thereof.

T. A fabric treatment composition according to any of paragraphs N-S, wherein the FCA comprises a quaternary ammonium ester compound, preferably in an amount of from about 2% to about 40%, more preferably from about 3% to about 25%, even more preferably from 4% to 18%, even more preferably from 5% to 15%, by weight of the composition.

U. A fabric treatment composition according to any of paragraphs N-T, wherein the FCA comprises a silicone, preferably in an amount of from about 0.1% to about 70%, more preferably from about 0.3% to about 40%, or more preferably from about 0.5% to about 30%, or even from about 1% to about 20%, by weight of the composition.

V. A fabric treatment composition according to any of paragraphs N-U, wherein the composition comprises a quaternary ammonium ester compound and a silicone, (a) wherein the combined total amount of quaternary ammonium ester compound and silicone is from about 5% to about 70%, or from about 6% to about 50%, or from about 7% to about 40%, or from about 10% to about 30%, or from about 15% to about 25%, by weight of the composition, or (b) wherein the quaternary ammonium ester compound and the silicone are present in a weight ratio of from about 1:10 to about 10:1, or from about 1:5 to about 5:1, or from about 1:3 to about 1:3, or from about 1:2 to about 2:1, or about 1:1.5 to about 1.5:1, or about 1:1, or (c) both (a) and (b).

W. A fabric treatment composition according to any of paragraphs N-V, wherein the fabric treatment composition further comprises a deposition aid, a structurant, or a combination thereof.

X. A fabric treatment composition according to any of paragraphs N-W, wherein the composition comprises a deposition aid, the deposition aid being a cationic polymer, preferably wherein the cationic polymer comprises a quaternium ammonium polymer, optionally wherein the composition comprises from 0.0001% to 3%, preferably from 0.0005% to 2%, more preferably from 0.001% to 1%, or from about 0.01% to about 0.5%, or from about 0.05% to about 0.3%, by weight of the composition, of the deposition aid.

Y. A fabric treatment composition according to any of paragraphs A-X, wherein the fabric treatment composition further comprises perfume, preferably neat perfume, emulsified perfume, encapsulated perfume, or combinations thereof.

Z. A fabric treatment composition according to any of paragraphs N-Y, wherein the composition comprises perfume, the perfume comprising: (i) from about 15% to about 60%, preferably from about 20% to about 55%, more preferably from about 25% to about 50%, by weight of the perfume, of non-enduring perfume ingredients; (ii) from about 2% to about 15%, preferably from about 3% to about 12%, more preferably from about 4% to about 10% by weight of the perfume accord of Quadrant I perfume ingredients; (iii) at least about 2%, or at least about 3%, or at least about 4%, by weight of the composition, of Quadrant I perfume ingredients; or (iv) combinations thereof.

AA. A fabric treatment composition according to any of paragraphs N-Z, wherein the composition comprises perfume, the perfume comprising: from about 2.5% to about 25%, preferably from about 3% to about 20%, more preferably from about 5% to about 15% of Quadrant II perfume ingredients; from about 10% to about 50%, preferably from about 15% to about 45%, more preferably from about 20% to about 40% of Quadrant III perfume ingredients; and/or about 40% to about 85%, preferably from about 45% to about 75%, more preferably from about 40% to about 65% of Quadrant IV perfume ingredients.

BB. A fabric treatment composition according any of paragraphs N-AA, wherein the composition is substantially free of anionic surfactant.

CC. A fabric treatment composition according to any of paragraphs N-BB, wherein the composition comprises from about 1%, or from about 10%, or from about 25%, or from about 50%, to about 90%, or to about 85%, or to about 80%, or to about 75%, by weight of the composition, of water.

DD. A process according to any of paragraphs A-M, wherein the fabric treatment composition is a fabric treatment composition according to any of paragraphs N-CC.

EE. A fabric treatment composition according to any of paragraphs N-CC, wherein the composition is a composition according any of those recited in any of paragraphs A-M.

FF. A use of a fabric treatment composition according to any of paragraphs N-CC, wherein the composition provides an anti-wrinkle benefit to a fabric, when the fabric is treated with a treatment liquor comprising water and the fabric treatment composition.

Test Methods

The following test methods are to be used to determine the relevant values and measurements described herein.

Density of Dispensed Composition

Tare a 150 mL glass beaker having volumetric markings (VWR catalog #89000-202) on a standard balance (e.g. Mettler PM4600). Dispense the foam product into the beaker, so that the beaker is filled with the foam to the 100 mL line. Minimize any unfilled volume (e.g. air pockets) by dispensing the foam in a circular fashion around the beaker. Once filled evenly to the 100 mL line, record the mass of the dispensed product (e.g., 14.8 g). Divide the mass (in grams) of the product dispensed by 100 mL, to obtain the density in g/mL (which may also be reported as $g/cm^3$).

Flow Rate of Dispensed Composition

To determine the flow rate of the dispensed composition, obtain a cup or container, and tare on a balance. Obtain a stop watch and the sample product. Begin the stopwatch and immediately dispense the foam product into the cup or container. After 5 seconds, immediately stop dispensing the product. Record the weight of the dispensed product and report the resulting flow rate in terms of g/sec. If the dispensed composition overflows the cup or container, disregard the trial and start again with a new cup or container of suitable size.

Foam Collapse Rate

To determine the foam collapse rate, tare a glass beaker having volumetric markings (e.g. 150 mL beaker, VWR catalog #89000-202) on a standard balance (ex. Mettler PM4600). Dispense the foam product into the beaker, evenly to the 100 mL line. Minimize any unfilled volume (e.g. air pockets), by dispensing the foam in a circular fashion around the beaker. Begin a timer immediately upon completion of dispensing the foam. (The beaker may be left undisturbed on the balance placed to record the weight, or placed on the bench top.) Record the foam volume (based on average foam height across the beaker) at desired time intervals (e.g. 2 minutes, 4 minutes, 6 minutes, 8 minutes, 10 minutes, etc.). Report foam volume as a function of time. Thus, a first, second, etc. "density" can be recorded at the given time interval. If desired, the final time can be recorded at which the foam collapses back to the density of the starting fluid (pre-dispensing), and/or when the foam volume does not appreciably change after three of the selected time intervals.

Method of Determining pH of a Fabric Softener Composition

The pH is measured on the neat fabric treatment composition (prior to dispensing and/or after the foam of the dispensed product has collapsed) using a Sartorius PT-10P pH meter with gel-filled probe (such as the Toledo probe, part number 52 000 100), calibrated according to the instructions manual.

Method of Determining Viscosity of a Fabric Treatment Composition

The viscosity of neat fabric treatment composition, in liquid form, is determined using a Brookfield® DV-E rotational viscometer, at 60 rpm, at 21° C. Spindle 2 is used for viscosities from 50 mPa·s to 400 mPa·s. Spindle 3 is used for viscosities from 401 mPa·s to 2.0 Pa·s.

Liquid compositions according to the present disclosure may be characterized by a viscosity of from about 50 to about 1500, or from about 75 to about 100, or from about 100 to about 500 mPa·s.

Method of Measuring Iodine Value of a Quaternary Ammonium Ester Compound

The iodine value of a quaternary ammonium ester fabric compound is the iodine value of the parent fatty acid from which the fabric conditioning active is formed, and is defined as the number of grams of iodine which react with 100 grams of parent fatty acid from which the fabric conditioning active is formed.

First, the quaternary ammonium ester compound is hydrolysed according to the following protocol: 25 g of fabric treatment composition is mixed with 50 mL of water and 0.3 mL of sodium hydroxide (50% activity). This mixture is boiled for at least an hour on a hotplate while avoiding that the mixture dries out. After an hour, the mixture is allowed to cool down and the pH is adjusted to neutral (pH between 6 and 8) with sulfuric acid 25% using pH strips or a calibrated pH electrode.

Next the fatty acid is extracted from the mixture via acidified liquid-liquid extraction with hexane or petroleum ether: the sample mixture is diluted with water/ethanol (1:1) to 160 mL in an extraction cylinder, 5 grams of sodium chloride, 0.3 mL of sulfuric acid (25% activity) and 50 mL of hexane are added. The cylinder is stoppered and shaken for at least 1 minute. Next, the cylinder is left to rest until 2 layers are formed. The top layer containing the fatty acid in hexane is transferred to another recipient. The hexane is then evaporated using a hotplate leaving behind the extracted fatty acid.

Next, the iodine value of the parent fatty acid from which the fabric conditioning active is formed is determined following ISO3961:2013. The method for calculating the iodine value of a parent fatty acid comprises dissolving a prescribed amount (from 0.1-3 g) into 15 mL of chloroform. The dissolved parent fatty acid is then reacted with 25 mL of iodine monochloride in acetic acid solution (0.1M). To this, 20 mL of 10% potassium iodide solution and 150 mL deionised water is added. After the addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acid enables the iodine value to be calculated.

Method of Measuring Fatty Acid Chain Length Distribution

The fatty acid chain length distribution of the quaternary ammonium ester fabric conditioning active refers to the chain length distribution of the parent fatty acid from which the fabric conditioning active is formed. It can be measured on the quaternary ammonium ester conditioning active or on the fatty acid extracted from the fabric softener composition as described in the method to determine the iodine value of a quaternary ammonium ester fabric conditioning active. The fatty acid chain length distribution is measured by dissolving 0.2 g of the quaternary ammonium ester conditioning active or extracted fatty acid in 3 mL of 2-butanol, 3 glass beads are added and the sample is vortexed at high speed for 4 minutes. An aliquot of this extract is then transferred into a 2 mL gas chromatography vial, which is then injected into the gas chromatogram inlet (250° C.) of the gas chromatograph (Agilent GC6890N) and the resultant bi-products are separated on a DB-5ms column (30 m×250 μm×1.0 μm, 2.0 mL/min). These bi-products are identified using a mass-spectrometer (Agilent MSD5973N, Chemstation Software version E.02.02) and the peak areas of the corresponding fatty acid chain lengths are measured. The fatty acid chain length distribution is determined by the relative ratios of the peak areas corresponding to each fatty acid chain length of interest as compared to the sum of all peaks corresponding to all fatty acid chain lengths.

Perfume Methods (incl. Determination of Log P)

In order to conduct the calculations involved in the computed-value test methods described herein, the starting information required includes the identity, weight percent, and molar percent of each PRM in the perfume being tested, as a proportion of that perfume, wherein all PRMs in the perfume composition are included in the calculations. Additionally for each of those PRMs, the molecular structure, and the values of various computationally-derived molecular descriptors are also required, as determined in accordance with the Test Method for the Generation of Molecular Descriptors described herein.

A. Test Method for the Generation of Molecular Descriptors

For each PRM in a perfume mixture or composition, its molecular structure is used to compute various molecular descriptors. The molecular structure is determined by the graphic molecular structure representations provided by the Chemical Abstract Service ("CAS"), a division of the American Chemical Society, Columbus, Ohio, U.S.A. These molecular structures may be obtained from the CAS Chemical Registry System database by looking up the index name or CAS number of each PRM. For PRMs, which at the time of their testing are not yet listed in the CAS Chemical Registry System database, other databases or information sources may be used to determine their structures. For a PRM which has potentially more than one isomer present, the molecular descriptor computations are conducted using only one isomer to represent that PRM. Of all the isomers of a given PRM, the one that is selected to represent that PRM is the isomer whose molecular structure is the most prevalent by weight % in the formulation. The structures for other potential isomers of that PRM are excluded from the computations. The molecular structure of the most prevalent isomer is paired with the total concentration of that PRM, where the concentration reflects the presence of all the isomers of that PRM.

A molecule editor or molecular sketching software program, such as ChemDraw (CambridgeSoft/PerkinElmer Inc., Waltham, Mass., U.S.A.), is used to duplicate the 2-dimensional molecular structure representing each PRM. Molecular structures should be represented as neutral species (quaternary nitrogen atoms are allowed) with no disconnected fragments (e.g., single structures with no counter ions). The winMolconn program described below can convert any deprotonated functional groups to the neutral form by adding the appropriate number of hydrogen atoms and will discard the counter ion.

For each PRM, the molecular sketching software is used to generate a file which describes the molecular structure of the PRM. The file(s) describing the molecular structures of the PRMs is subsequently submitted to the computer software program winMolconn, version 1.0.1.3 (Hall Associates Consulting, Quincy, Mass., U.S.A., www.molconn.com), in order to derive various molecular descriptors for each PRM. As such, it is the winMolconn software program which dictates the structure notations and file formats that are acceptable options. These options include either a MACCS SDF formatted file (i.e., a Structure-Data File); or a Simplified Molecular Input Line Entry Specification (i.e., a SMILES string structure line notation) which is commonly used within a simple text file, often with a ".smi" or ".txt" file name extension. The SDF file represents each molecular structure in the format of a multi-line record, while the syntax for a SMILES structure is a single line of text with no white space. A structure name or identifier can be added to the SMILES string by including it on the same line following the SMILES string and separated by a space, e.g.: C1=CC=CC=C1 benzene.

The winMolconn software program is used to generate numerous molecular descriptors for each PRM, which are then output in a table format. Specific molecular descriptors derived by winMolconn are subsequently used as inputs (i.e., as variable terms in mathematical equations) for a variety of computer model test methods in order to calculate values such as: saturation Vapour Pressure (VP); Boiling Point (BP); logarithm of the Octanol/Water Partition Coefficient (log P); Odour Detection Threshold (ODT); Malodour Reduction Value (MORV); and/or Universal Malodour Reduction Value (Universal MORV) for each PRM. The molecular descriptor labels used in the models' test method computations are the same labels reported by the winMolconn program, and their descriptions and definitions can be found listed in the winMolconn documentation. The following is a generic description of how to execute the winMolconn software program and generate the required molecular structure descriptors for each PRM in a composition.

Computing Molecular Structure Descriptors using winMolconn:

1) Assemble the molecular structure for one or more perfume ingredients in the form of a MACCS Structure-Data File, also called an SDF file, or as a SMILES file.
2) Using version 1.0.1.3 of the winMolconn program, running on an appropriate computer, compute the full complement of molecular descriptors that are available from the program, using the SDF or SMILES file described above as input.
   a. The output of winMolconn is in the form of an ASCII text file, typically space delimited, containing the structure identifiers in the first column and respective molecular descriptors in the remaining columns for each structure in the input file.
3) Parse the text file into columns using a spreadsheet software program or some other appropriate technique. The molecular descriptor labels are found on the first row of the resulting table.
4) Find and extract the descriptor columns, identified by the molecular descriptor label, corresponding to the inputs required for each model.
   a. Note that the winMolconn molecular descriptor labels are case-sensitive.

B. Test Method for Determining Saturation Vapour Pressure (VP)

The saturation Vapour Pressure (VP) values are computed for each PRM in the perfume mixture being tested. The VP of an individual PRM is calculated using the VP Computational Model, version 14.02 (Linux) available from Advanced Chemistry Development Inc. (ACD/Labs) (Toronto, Canada) to provide the VP value at 25° C. expressed in units of torr. The ACD/Labs' Vapor Pressure model is part of the ACD/Labs model suite.

C. Test Method for Determining the Logarithm of the Octanol/Water Partition Coefficient (Log P)

The value of the log of the Octanol/Water Partition Coefficient (Log P) is computed for each PRM in the perfume mixture being tested. The log P of an individual PRM is calculated using the Consensus log P Computational Model, version 14.02 (Linux) available from Advanced Chemistry Development Inc. (ACD/Labs) (Toronto, Canada) to provide the unitless log P value. The ACD/Labs' Consensus log P Computational Model is part of the ACD/Labs model suite.

EXAMPLES

The examples provided below are intended to be illustrative in nature and are not intended to be limiting.

Example 1

Propellant Selection

In the following example, a fabric treatment composition comprising 10 wt % of an ester quaternary ammonium compound and 9 wt % of a silicone, each by weight of the composition, is provided in a pressurized aerosol bottle. Each bottle includes a valve having two apertures, each having a diameter of 0.025 inches.

Each bottle varies by propellant type and/or level, as provided in Table 1. Below is a key for each of the propellants listed.

A31: hydrocarbon (isobutane)
A46: hydrocarbon (mixture of isobutane and propane)
152A: hydrofluorocarbon (1,1-difluoroethane)
1234ze: hydrofluoroolefin (1,3,3,3-tetrafluoropropene)

Approximately equal amounts of foam are dispensed from each bottle, and the density of the foam is determined immediately; results are provided in Table 1.

TABLE 1

| Propellant Type | Wt % Propellant | Foam Density (g/L) | Amount of FCA delivered in 90 mL of foam (in grams, at 19% active) |
|---|---|---|---|
| A31 | 3% | 114 g/L | 2.0 g |
| A46 | 3% | 120 g/L | 2.1 g |
| 152A | 3% | 150 g/L | 2.6 g |

TABLE 1-continued

| Propellant Type | Wt % Propellant | Foam Density (g/L) | Amount of FCA delivered in 90 mL of foam (in grams, at 19% active) |
|---|---|---|---|
| 152A | 2% | 240 g/L | 4.1 g |
| 54% 152A + 46% A31 | 5% | 93 g/L | 1.6 g |
| 20% 152A + 80% A31 | 5% | 135 g/L | 2.3 g |
| 1234ze | 10% | 70 g/L | 1.2 g |
| 1234ze | 5% | 148 g/L | 2.5 g |
| 1234ze | 4% | 181 g/L | 3.1 g |
| 1234ze | 3.5% | 211 g/L | 3.6 g |
| 1234ze | 3% | 250 g/L | 4.3 g |

Additionally, trials are run using (1) nitrogen and (2) a combination of A31 and isopentane as propellants, but the resulting compositions did not significantly foam.

Furthermore, it is noted that the 1234ze propellant provided a foam with preferred aesthetics; namely, the resulting foams displayed a pleasing "shine." The foam produced from the 152A propellant included a shine but less than that of the 1234ze foam, and foams produced with A31 and A56 propellants did not show a significant shine.

Example 2

Propellant Levels

The following products are prepared, dispensed, and measured for foam density immediately after dispensing the composition. The active level reflects the amount of active in the liquid composition prior to adding the propellant. The propellant type is 1234ze. Based on the active level and the foam density, the amount of FCA delivered per 90 mL of foam is determined. Results are provided in Table 2.

TABLE 2

| Active Level (% FCA) | Wt % Propellant (1234ze) | Foam Density (g/L) | Amount of FCA delivered in 90 mL of foam (in grams) |
|---|---|---|---|
| 9.5% FCA | 12% | 80 g/L | 0.7 g |
| 9.5% FCA | 5% | 135 g/L | 1.2 g |
| 9.5% FCA + cationic polymer deposition aid (2% Merquat 280) | 5% | 130 g/L | 1.1 g |
| 65% FCA (silicone) | 10% | 90 g/L | 5.3 g |

Example 3

Valve Selection

To show the effect of valve selection on flow rate and amount of active delivered given a certain period of time, a fabric treatment composition comprising 19 wt % FCA (10% ester quat, 9% silicone) is prepared. The composition is packaged in three pressurized bottles; the amount and type of propellant (3 wt % 1234ze propellant, by weight of the treatment composition) is the same for each. However, each bottle includes a different valve as provided in Table 3. The fabric treatment composition is dispensed from each bottle, and the density and flow rate is determined; results are shown in Table 3. The hypothetical approximate volume of foam (flow rate×5 seconds×1000/density) and amount of FCA delivered in a five-second spray is calculated (flow rate×5 seconds×19%); the calculated values are also provided in Table 3. Five seconds is selected as a spray time that is believed to be consumer acceptable.

TABLE 3

| | A | B | C |
|---|---|---|---|
| Valve (number apertures × diameter in inches) | 2 × 0.025 | 2 × 0.041 | 4 × 0.047 |
| Density (g/L) | 250 g/L | 260 g/L | 250 g/L |
| Flow rate (grams of foam/sec) | 1 g/sec | 5 g/sec | 30 g/sec |
| Volume of foam delivered in five seconds (mL)* | 20 mL | 96 mL | 600 mL |
| FCA delivered in five seconds (grams)* | 0.95 g | 4.75 g | 28.5 g |

As shown in Table 3, when propellant is held constant and the valve type changes, the density of the dispensed foam remains relatively the same. However, the flow rate varies, which in turn affects the foam volume and delivered FCA in a given period of time.

Example 4

Foam Collapse Over Time

To demonstrate the foam collapse properties of compositions according to the present disclosure, a pressurized aerosol can is prepared with a fabric treatment composition containing about 9.5% of an ester quat FCA (prior to addition of propellant) and about 10% of a propellant (10% HFO). About 100 mL of the composition is dispensed as a foam into a 150 mL glass beaker having volumetric graduation lines. The approximate volume of the foam is recorded over ten minutes. The mass of the dispensed composition recorded and density at each time interval is determined. Results are shown in Table 4.

TABLE 4

| Time (min.) | Approx. foam volume (mL) | Density (g/mL) |
|---|---|---|
| 0 | 100 | 0.07 g/mL |
| 2 | 90 | 0.08 g/mL |
| 4 | 40 | 0.18 g/mL |
| 5 | 20 | 0.35 g/mL |
| 6 | 10 | 0.7 g/mL |
| 8 | 10 | 0.7 g/mL |
| 10 | 10 | 0.7 g/mL |

As shown in Table 4, the dispensed composition shows good foam collapse, experiencing an approximate 10× decrease in volume in as soon as six minutes (100 mL to 10 mL). Foam bubbles were still visible at 10 minutes, but the rate of collapse had slowed, as shown by the constant volume measurements over the last three time intervals.

Example 5

Foam Collapse vs. Propellant Levels

To show the effect of propellant levels on the relative amount of foam collapse, three bottles of fabric treatment composition (19% active: 10% ester quat, 9% silicone) are prepared, each with a different level of propellant as shown in Table 5. Upon dispensing a sample from each bottle, a first density is taken at time zero, and a second density is determined approximately 10 minutes later. Based on the first density and the amount of FCA (19 wt %), the approximate amount of FCA that is delivered in a 90 mL sample of the foam as initially dispensed is determined.

TABLE 5

| % Propellant | First density (t = 0') | Amount of FCA delivered (in g) per 90 mL of foam (t = 0') | Second density (t = 10') |
|---|---|---|---|
| 3% | ~0.25 g/mL | ~4.3 g | ~0.9 g/mL |
| 5% | ~0.15 g/mL | ~2.6 g | ~0.9 g/mL |
| 10% | ~0.06 g/mL | ~1.0 g | ~0.9 g/mL |

As shown by the data in Table 5, the initial densities of the foams delivered varied according to propellant level; namely, greater levels of propellant provide foams having lower densities. However, after ten minutes, each of the tested foams had collapsed to a density of about 0.9 g/mL, a near-water-like density and the approximate density of the fabric treatment composition in liquid form (e.g., when not a foam). This is also the approximate density of commercially available liquid fabric enhancers.

Example 6

Foam Collapse vs. Active Levels

To show the relationship between active level (e.g., silicone) and foam collapse, a qualitative study is performed. Pressurized plastic bottles containing a fabric treatment composition are prepared. The fabric treatment composition includes 10 wt % of an ester quaternary ammonium compound, propellant (a hydrofluoroolefin), and varying amounts of silicone as approximated below in Table 6. Approximately equivalent amounts of the composition are dispensed from each of the three bottles on to a paper towel, and the resulting foam samples are observed for foam collapse. The samples are ranked according to which sample collapsed the fastest to a liquid-like consistency (e.g., absorbed by the paper towel with few bubbles remaining, if any).

The results are shown in Table 6, where 1=fastest foam collapse, and 3=slowest foam collapse.

TABLE 6

| | 3% Silicone (13% total active) | 6% Silicone (16% total active) | 9% Silicone (19% total active) |
|---|---|---|---|
| 3% Propellant | 3 | 2 | 1 |

As shown in Table 6, the amount of silicone can affect the rate of collapse when the amount of propellant is held constant; in general, the greater the level of silicone, the faster the foam collapses. It is believed that the silicone, particularly at higher levels, acts as a foam collapse agent.

Example 7

Deposition Aid Effects

To test for the effects of a deposition aid on foam collapse and dispensing efficiency, two fabric treatment formulations are prepared, where one includes a cationic polymer as deposition aid. The general formulations are provided below in Table 7A, with levels provided as percentages by weight of the composition prior to the addition of propellant and deposition aid, if any. While Formulation 1 provides good performance on target fabrics, Formulation 2 is expected (everything else being equal) to have even better performance due to presence of the deposition aid.

TABLE 7A

| | Formulation 1 | Formulation 2 |
|---|---|---|
| FCA (ester quat) | 9.5% | 9.5% |
| Structurant (Rheovis CDE) | 0.15% | 0.15% |
| Deposition Aid Polymer[1] | 0% | 2.0% |
| Perfume | 0.1-1% | 0.1-1% |

[1]Polyquat 22 (Merquat 280, available from Lubrizol)

A. Comparison of Initial Foam and Foam Collapse

To compare the initial foam and relative foam collapse, the two compositions are dispensed in approximately equal amounts from pressurized bottles having the same level of propellant onto a benchtop.

Figure 4:
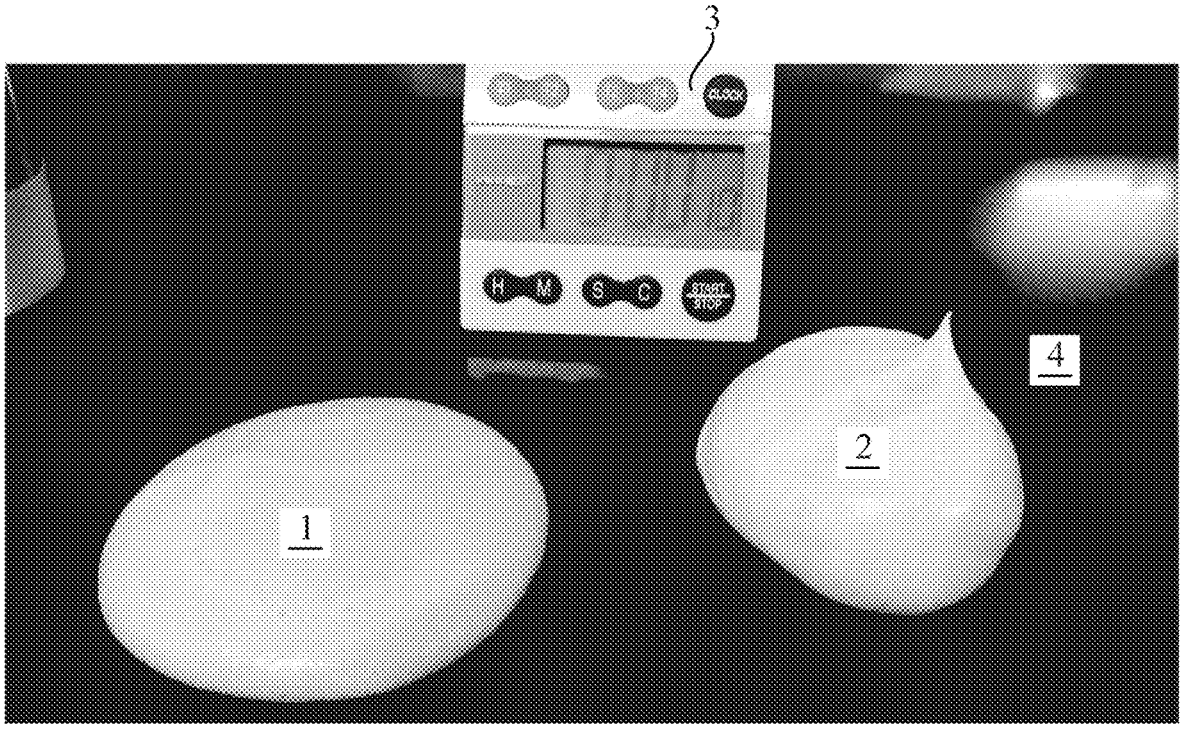
FIG. 4 shows a photograph of two foam compositions as initially dispensed.

FIG. 4 shows a photograph of approximately equal amounts of the two compositions as initially dispensed. The foam 1 on the left is a composition according to Formulation 1, and the foam 2 on the right is a composition according to Formulation 2. The photograph is taken approximately 10 seconds, as timed by a timer 3, after dispensing the compositions on to a lab benchtop 4. As shown in FIG. 4, the foam 1 according to Formulation 1 has relatively lower height and has spread out, while the foam 2 according to Formulation 2 maintains a greater height and is more compact.

Figure 5:
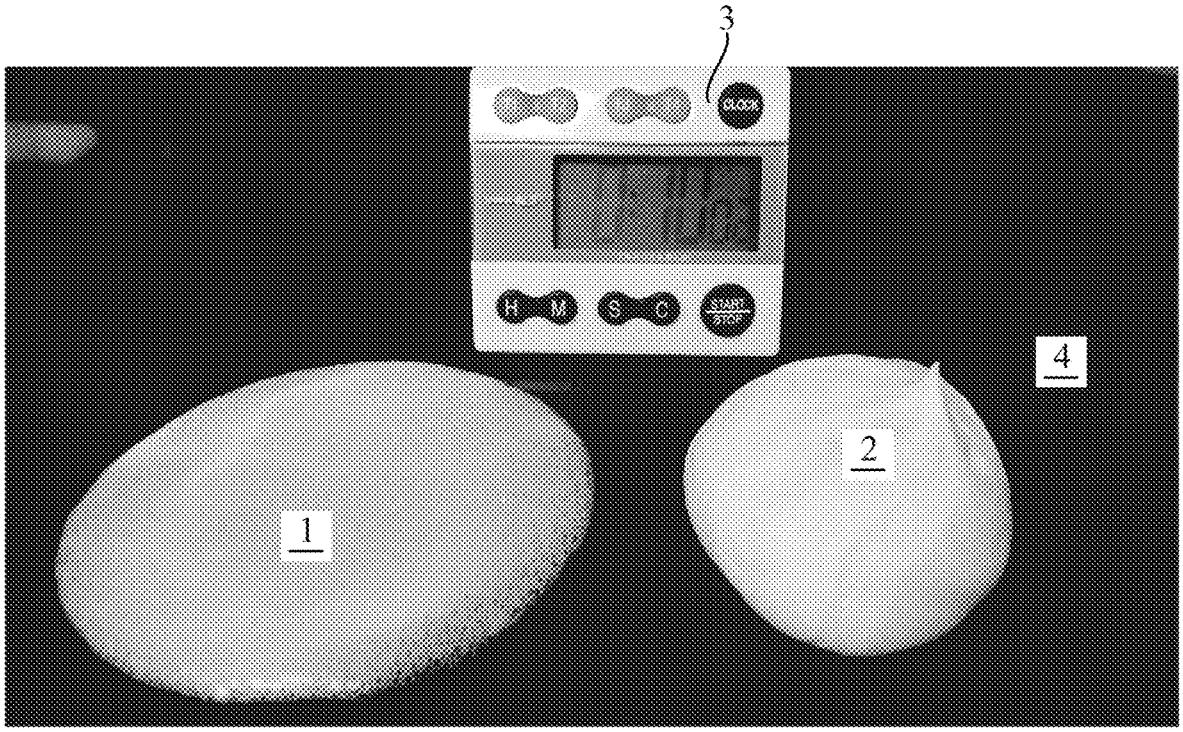
FIG. 5 shows a photograph of the same compositions, approximately ten minutes later.

FIG. 5 shows a photograph of the same foams 1, 2 after approximately ten minutes. The foam 1 according to Formulation 1 has spread out even further, and larger bubbles are visible, indicating gas loss and foam collapse. The foam 2 according Formulation 2, on the other hand, has substantially maintained its shape and height. It is observed that the foam 1 according to Formulation 1 is relatively more liquid-like after ten minutes.

B. Dispensing Efficiency

A single-cycle dispensing efficiency test is performed with both compositions. In separate test legs, approx. 20 g of Formulations 1 and 2 are dispensed as foam into the center post dispenser of a traditional top-loader machine (Kenmore 600 series). After running a single cycle on the "normal" setting (12 minutes wash cycle, 17 gallons of wash water at 90° F., 2 minute spin, then a rinse cycle), the dispensers are analyzed for the amount of composition dispensed into the machine compared to the original amount present. Results are shown in Table 7B.

TABLE 7B

| | Formulation 1 | Formulation 2 |
|---|---|---|
| Dispensing Efficiency (as % of original amount) | Approx. 90-95% | Approx. 25% |

As shown in Table 7B, Formulation 2, which includes a relatively high level of deposition aid, results in a lower degree of dispensing efficiency (approx. 25%) compared to Formulation 1 (approx. 90-95%). This means that relatively less of Formulation 2 flows into the drum during a rinse cycle where it can treat the target fabrics. Without being bound by theory, it is believed that Formulation 1 collapses more quickly than Formulation 2 (see discussion of FIGS. 1 and 2 above) during the wash cycle of the machine, allowing the collapsed composition to flow into the drum more easily during the subsequent rinse cycle. To note, the dispensing efficiency of Formulation 1 is not dissimilar from the dispensing efficiency typically associated with traditional liquid fabric enhancer products.

C. Phase Stability

Upon observation, Formulation 1 has better phase stability than Formulation 2. Formulation 1 remains relatively homogenous, whereas Formulation 2 phase splits over within several hours of making the composition.

Example 8

FCA Levels vs. Dispensing Efficiency

To test the effect that active levels have on dispensing efficiency, a single-cycle dispensing efficiency test is performed with compositions having varying levels of silicone. In separate test legs, approx. 21-22 g of fabric treatment compositions having about 10 wt % of an ester quaternary ammonium compound, varying levels of silicone (3 wt %, 6 wt %, 9 wt %), and the same propellant levels (4% HFO) are dispensed as foam into the center post dispenser of a traditional top-loader machine (Kenmore 600 series). After running a single cycle on the "normal" setting (12 minutes, 17 gallons of wash water at 90F), the dispensers are analyzed for dispensing efficiency of the composition compared to the original amount present. Results are shown in Table 8.

TABLE 8

| Silicone Level | Dispensing Efficiency (as % of original amount) |
|---|---|
| 3% | 85.7% |
| 6% | 88.2% |
| 9% | 85.0% |

As shown in Table 8, increasing the amount of active ingredient (namely, silicone) does not greatly impact the dispensing efficiency for the compositions tested. For example, tripling the amount of silicone (from 3% to 9%) results in less than a percentage point difference in dispensing efficiency (85.7% vs. 85.0%), which is believed to be within the error margin of the test.

The results of this test are believed to be generally consistent with the results shown above in Table A, which show that compositions having the same propellant levels exhibit relatively similar degree of foam collapse, despite differences in silicone levels. As previously mentioned, it is believed that foams that sufficiently collapse are more efficiently dispensed into the rinse cycle of an automatic washing machine.

Example 9

Exemplary Formulations

Table 9 below shows exemplary formulations of fabric treatment compositions according to the present disclosure. Amounts provided are in weight percent of the listed ingredient, unless otherwise indicated. The ingredients (ester quat, if any, through water, etc.) were mixed in the provided levels, then propellant was added at the provided level and the resulting mixture was provided to a container. The compositions were dispensed, and density was determined immediately after dispensing.

TABLE 9

| Ingredients | 1 | 2 | 3 | 4 | 5 | 6 | 7 | 8 | 9 | 10 | 11 |
|---|---|---|---|---|---|---|---|---|---|---|---|
| Ester Quat[1] | 21.9 | 21.9 | 21.9 | 21.9 | 22.0 | 22.0 | 22.0 | — | — | — | — |
| Ester Quat[2] | — | — | — | — | — | — | — | 8.8 | 8.8 | 8.7 | — |
| Silicone | 8.2 | 8.2 | 8.2 | 8.2 | 9.2 | 9.2 | 9.2 | — | — | — | 65 |
| Neat Perfume | 1.6 | 1.6 | 1.6 | 1.6 | 1.6 | 1.6 | 1.6 | 1.3 | 1.3 | 1.3 | — |
| Encapsulated Perfume[3] | 0.25 | 0.25 | 0.25 | 0.25 | 0.25 | 0.25 | 0.25 | 0.25 | 0.25 | 0.25 | — |
| Structurant[4] | — | — | — | — | — | — | — | 0.15 | 0.15 | 0.15 | — |
| Cationic polymer[5] | 2.5 | 2.5 | 2.5 | 2.5 | 1 | 1 | 1 | — | — | — | — |
| Cationic polymer[6] | — | — | — | — | — | — | — | — | — | 2 | — |
| Water and minors (chelant, preservative, etc.) | | | | | | Balance | | | | | |
| Propellant[7] | 5.8 | 10.5 | 18.5 | 2.8 | 5 | 2 | 1.3 | 12 | 5 | 5 | 10 |
| Foam Density (g/mL) | 0.14 | 0.06 | 0.05 | 0.32 | 0.14 | 0.62 | 0.7 | 0.08 | 0.13 | 0.13 | 0.09 |

[1]Provided as a 25% active

[2]Provided as a 9% active

[3]Core-in-shell encapsulates, comprising a wall material of melamine formaldehyde, and a deposition aid coating comprising polyvinyl formamide

[4]Rheovis CDE (ex BASF)

[5]Luviquat PQ-11 (ex BASF)

[6]Merquat 280 (ex Lubrizol)

[7]HFO propellant (1234ze)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric treatment composition, the fabric treatment composition comprising a fabric conditioning active (FCA), wherein the FCA comprises a quaternary ammonium ester compound and a silicone, wherein the silicone is present at a level of from about 0.5% to about 30%, by weight of the composition, and wherein the combined total amount of quaternary ammonium ester compound and silicone is from about 5% to about 70%, by weight of the composition, the composition further comprising encapsulated perfume, wherein the fabric treatment composition is contained in a pressurized container.

2. A fabric treatment composition according to claim 1, wherein the FCA further comprises a member selected from the group consisting of non-ester quaternary ammonium compounds, amines, fatty esters, sucrose esters, silicones, dispersible polyolefins, polysaccharides, fatty acids, softening or conditioning oils, polymer latexes, or combinations thereof.

3. A fabric treatment composition according to claim 1, wherein the quaternary ammonium ester compound and the silicone are present in a weight ratio of from about 1:10 to about 10:1.

4. A fabric treatment composition according to claim 1, wherein the fabric treatment composition further comprises a deposition aid, a structurant, or a combination thereof.

5. A fabric treatment composition to claim 1, wherein the composition is substantially free of anionic surfactant.

6. A fabric treatment composition according to claim 1, wherein the composition comprises from about 1% to about 90% of water.

7. The fabric treatment composition according to claim 1, wherein the fabric treatment composition, when in the container, comprises from about 1% to about 12%, by weight of the fabric treatment composition, of a propellant.

8. The fabric treatment composition according to claim 7, wherein the propellant is selected from hydrocarbons, hydrofluorocarbons (HFCs), hydrofluoroolefins (HFOs), nitrogen, carbon dioxide, compressed air, or combinations thereof.

9. The fabric treatment composition according to claim 8, wherein the propellant comprises hydrofluoroolefins (HFOs).

* * * * *